US010906673B2

(12) United States Patent
Springhorn et al.

(10) Patent No.: US 10,906,673 B2
(45) Date of Patent: Feb. 2, 2021

(54) METHOD AND APPARATUS FOR FILLING A FLEXIBLE FILM BAG ATTACHED TO A FACE PLATE

(71) Applicant: NORDSON CORPORATION, Westlake, OH (US)

(72) Inventors: Robert W. Springhorn, Cream Ridge, NJ (US); Brian Dauphinais, Brooklyn, CT (US)

(73) Assignee: Nordson Corporation, Westlake, OH (US)

( * ) Notice: Subject to any disclaimer, the term of this patent is extended or adjusted under 35 U.S.C. 154(b) by 175 days.

(21) Appl. No.: 16/214,024

(22) Filed: Dec. 7, 2018

(65) Prior Publication Data

US 2019/0177014 A1 Jun. 13, 2019

Related U.S. Application Data

(60) Provisional application No. 62/596,616, filed on Dec. 8, 2017.

(51) Int. Cl.
*B65B 3/16* (2006.01)
*B65B 3/36* (2006.01)
(Continued)

(52) U.S. Cl.
CPC ..... *B65B 3/16* (2013.01); *B65B 3/045* (2013.01); *B65B 3/12* (2013.01); *B65B 3/36* (2013.01);
(Continued)

(58) Field of Classification Search
CPC .. B65B 3/045; B65B 3/12; B65B 3/14; B65B 3/16; B65B 3/36; B65B 29/00;
(Continued)

(56) References Cited

U.S. PATENT DOCUMENTS 3,032,037 A * 5/1962 Huber ..... A61M 1/0011 604/245
3,206,074 A * 9/1965 Hoffmann ..... B65D 81/3244 222/94
(Continued)

FOREIGN PATENT DOCUMENTS

DE 2610396 A1 * 9/1977 ..... B65B 39/12
DE 3809347 A1 * 10/1989 ..... B65B 39/14
(Continued)

OTHER PUBLICATIONS

ISA/220—Notification of Transmittal of Search Report and Written Opinion of the ISA, or the Declaration dated Mar. 26, 2019 for WO Application No. PCT/US18/064389.

*Primary Examiner* — Stephen F. Gerrity
(74) *Attorney, Agent, or Firm* — Baker & Hostetler LLP

(57) ABSTRACT

A method and system for filling a flexible film bag attached to a face plate with a flowable composition is disclosed. The system includes a chamber for receiving the flexible film bag and a fill tube for dispensing the flowable composition into the flexible film bag, where the fill tube is at least partially disposed in the film bag. The system also includes a first pump in fluid communication with the chamber, where the first pump creates a vacuum between an exterior surface of the flexible film bag and an interior surface of the chamber, such that the flexible film bag expands from an unexpanded state to an expanded state.

24 Claims, 28 Drawing Sheets

(51) Int. Cl.

| | |
|---|---|
| ***B65B 3/12*** | (2006.01) |
| ***B65B 3/04*** | (2006.01) |
| ***B65B 31/02*** | (2006.01) |
| ***B65B 29/10*** | (2006.01) |
| ***B65B 39/12*** | (2006.01) |

(52) U.S. Cl.
CPC ..... *B65B 29/10* (2013.01); *B65B 31/024* (2013.01); *B65B 39/12* (2013.01)

(58) Field of Classification Search
CPC ..... B65B 29/10; B65B 31/024; B65B 37/06; B65B 37/14; B65B 39/04; B65B 39/12; B65B 2230/02; B05C 17/003
USPC .... 53/469, 471, 281, 284.7, 386.1; 141/193, 141/263
See application file for complete search history.

(56) References Cited

U.S. PATENT DOCUMENTS

| | | | | | |
|---|---|---|---|---|---|
| 3,323,682 | A * | 6/1967 | Creighton, Jr. | B05C 17/00516 | 222/94 |
| 3,336,724 | A * | 8/1967 | Tarukawa | B65B 57/00 | 53/503 |
| 3,719,213 | A | 3/1973 | Quick | | |
| 4,084,626 | A * | 4/1978 | King | B65B 59/003 | 141/7 |
| 4,537,230 | A * | 8/1985 | Schindel | B65B 39/12 | 141/146 |
| 4,685,494 | A | 8/1987 | Lofgren et al. | | |
| 5,054,274 | A | 10/1991 | Tanaka | | |
| 5,209,044 | A * | 5/1993 | D'Addario et al. | B65B 3/04 | 53/272 |
| 5,551,493 | A * | 9/1996 | Sonntag et al. | B65B 3/32 | 141/260 |
| 5,593,066 | A | 1/1997 | Konuma et al. | | |
| 5,775,386 | A * | 7/1998 | Connan | B65B 29/10 | 141/103 |
| 5,921,293 | A * | 7/1999 | Berger et al. | B65B 3/22 | 141/192 |
| 2002/0020718 | A1 | 2/2002 | Summons et al. | | |
| 2002/0195166 | A1* | 12/2002 | Hattori et al. | B65B 3/16 | 141/114 |
| 2003/0197022 | A1* | 10/2003 | Keller | B65B 3/045 | 222/105 |
| 2005/0198927 | A1 | 9/2005 | Summons et al. | | |
| 2011/0192734 | A1* | 8/2011 | Helou, Jr. | B65D 81/3222 | 206/219 |
| 2012/0275867 | A1* | 11/2012 | Jones et al. | B65B 29/10 | 405/259.6 |

FOREIGN PATENT DOCUMENTS

| | | | | |
|---|---|---|---|---|
| EP | 0130161 | A2 | 1/1985 | |
| EP | 0474931 | A1 | 3/1992 | |
| JP | 03162225 | A * | 7/1991 | B65B 39/12 |
| WO | 01/17869 | A1 | 3/2001 | |

* cited by examiner

METHOD AND APPARATUS FOR FILLING A FLEXIBLE FILM BAG ATTACHED TO A FACE PLATE

CROSS REFERENCE TO RELATED APPLICATIONS

This application claims the benefit of Provisional Patent App. No. 62/596,616, filed Dec. 8, 2017, the disclosure of which is hereby incorporated by reference herein.

TECHNICAL FIELD

The present disclosure relates to a system and method for filling a package with a flowable composition.

BACKGROUND

Various compositions are packaged in tubular cartridges for use in caulking guns and other types of dispensing mechanisms. In some instances, the dispensing mechanisms will take two or more cartridges side-by-side so that the contents of the cartridges are dispensed simultaneously and admixed in a mixer as they flow towards the point of deposition. Typically, such cartridges have employed tubes of plastic, or coated or laminated paperboard, and the like. Moreover, the tubes generally include flexible packaging that has been filled through one end packaging, after which a closure is placed thereover. Using such side-by-side cartridges to dispense two components involves a substantial amount of waste and expense.

When filling such flexible packaging, it is important to fill the packaging to a consistent volume so that a known fill volume can be set on the filling apparatus. However, during filling many volumetric filling inconsistencies can occur that cause each flexible packaging unit to be filled with different amounts of flowable composition. These inconsistencies can result from such factors as air entrapment within the flowable composition during filling, uneven unfolding of the flexible packaging, or an improper retraction rate from the flexible packaging of a fill tube that is performing the filling operation. One previously presented solution to address these issues is to apply a positive pressure to the interior of the flexible packaging during the filling operation. However, this method has some downsides, as it risks the source of positive pressure being contaminated with the flowable composition during filling.

As a result, there is a need for a system and method for consistently filling a flexible packaging with a flowable composition to a desired maximum capacity.

SUMMARY

An embodiment of the present disclosure is a method for filling a flexible film bag attached to a face plate with a flowable composition. The method includes inserting the flexible film bag into a chamber and creating a vacuum between an exterior surface of the flexible film bag and an interior surface of the chamber, such that the flexible film bag expands from an unexpanded state to an expanded state. The method also includes inserting a fill tube into the flexible film pack through the face plate, and dispensing the flowable composition through the fill tube and into the flexible film bag.

Another embodiment of the present disclosure is a system for filling a flexible film bag attached to a face plate with a flowable composition. The system includes a chamber for receiving the flexible film bag and a fill tube for dispensing the flowable composition into the flexible film bag, where the fill tube is configured to be at least partially inserted into the flexible film bag. The system also includes a first pump in fluid communication with the chamber, wherein the first pump is configured to create a vacuum between an exterior surface of the flexible film bag and an interior surface of the chamber, such that the flexible film bag expands from an unexpanded state to an expanded state.

BRIEF DESCRIPTION OF THE DRAWINGS

The foregoing summary, as well as the following detailed description, will be better understood when read in conjunction with the appended drawings. The drawings show illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
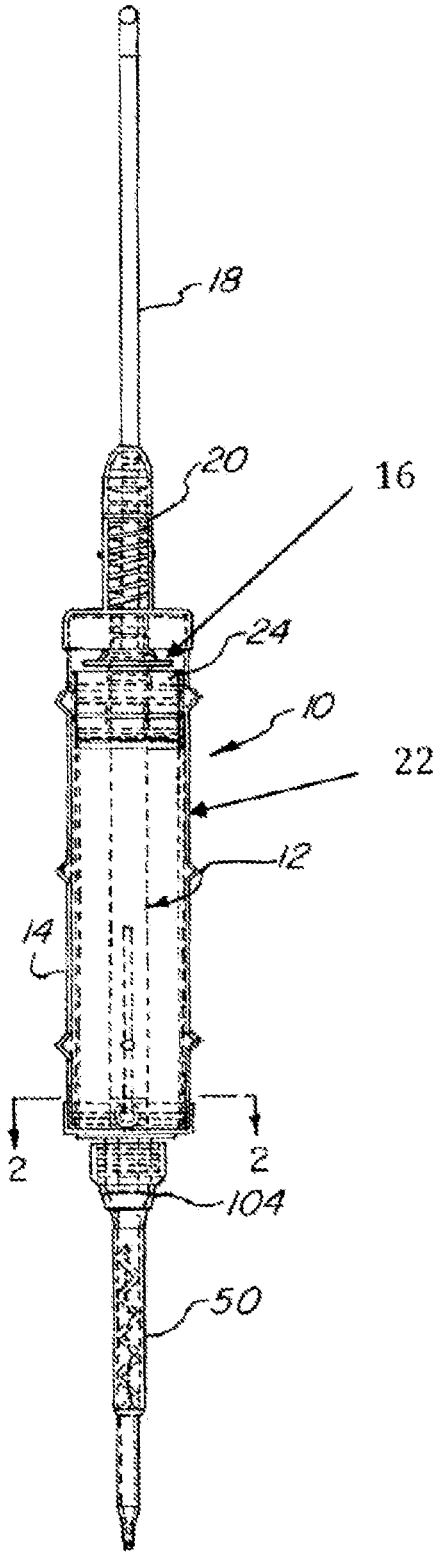
FIG. 1 is a longitudinal view in partial section of a cartridge dispenser in which there is seated a film pack container in accordance with an embodiment of the invention.
Figure 2:
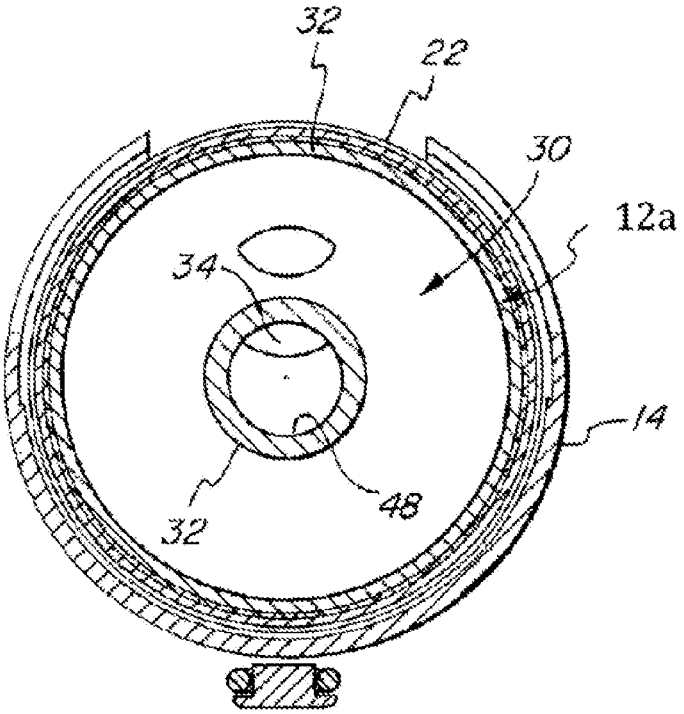
FIG. 2 is a sectional view the film pack container and dispenser along the line 2-2 of FIG. 1.
Figure 3:
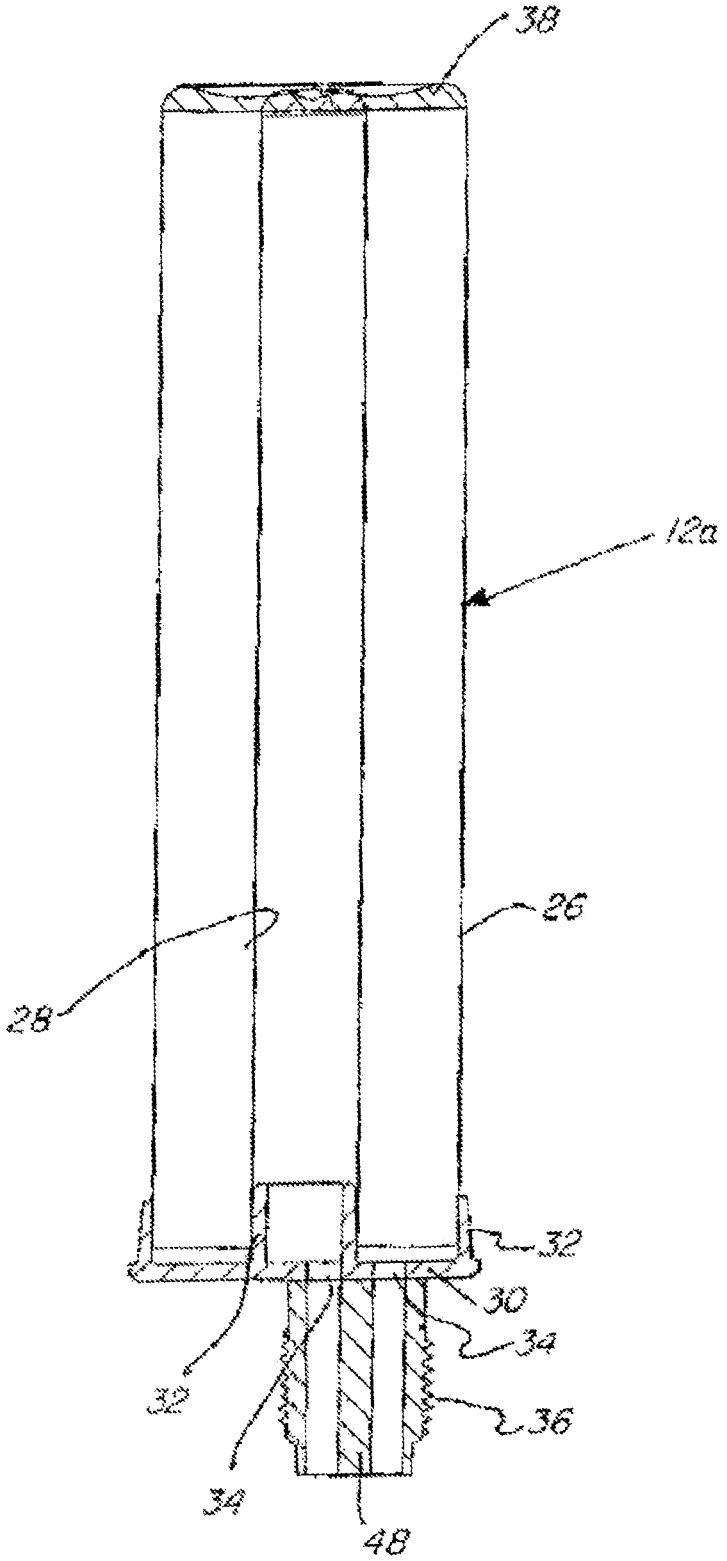
FIG. 3 is a longitudinal sectional view of the film pack container of FIG. 1.

Described herein is a film pack 500 that includes two flexible film bags 502, 504 configured to be filled with a flowable composition, a fill system 600 for consistently filling the film bags 502, 504, and a method for filling the film bags 502, 504. The film pack 500 can comprise a Film-Pak®, which is produced by the Nordson Corporation of Westlake, Ohio. Certain terminology is used to describe the elements in the following description for convenience only and is not limiting. The words "right", "left", "lower," and "upper" designate directions in the drawings to which reference is made. The words "inner" and "outer" refer to directions toward and away from, respectively, the geometric center of the description to describe the noted feature and related parts thereof. The terminology includes the above-listed words, derivatives thereof, and words of similar import.

Turning first to FIG. 1, therein illustrated is a conventional caulking gun 10 in which is seated a filled film bag cartridge 12. The caulking gun 10 has an arcuate housing 14, an end plate 16, a piston/rod 18 and an actuator assembly 20. Disposed in the housing 14 is the cartridge 12 which is supported in the cylindrical sleeve 22, and a cylindrical shuttle 24 which is moved in the sleeve 22 against the cartridge 12 by the piston/rod 18.

Turning next to FIGS. 2-5, therein illustrated is a film bag cartridge 12 in which there is an outer annular bag 26, an inner cylindrical bag 28 and a face plate generally designated by the numeral 30 to which one end of the bags 26, 28 are adhered. The face plate 30 has rearwardly projecting flanges 32 which provide the surface to which the bags 26, 28 are adhered, and a discharge opening generally designated by the numeral 34. Extending about the discharge opening 34 and extending forwardly is a nosepiece 36. The opposite ends of the bags 26, 28 are sealed as indicated by the cross hatching 38.

Figure 4A:
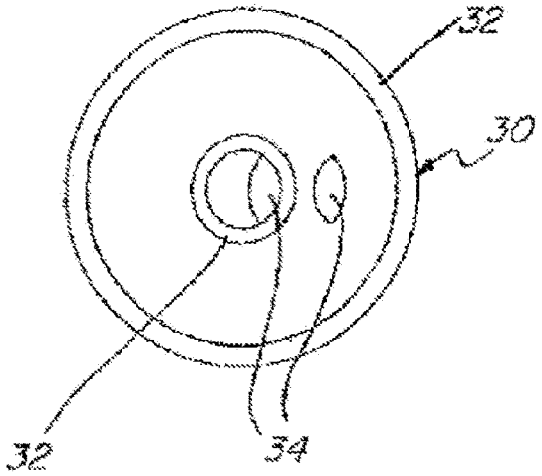
FIG. 4A is a rear view of a face plate of the film pack container shown in FIGS. 2 and 3.
Figure 4B:
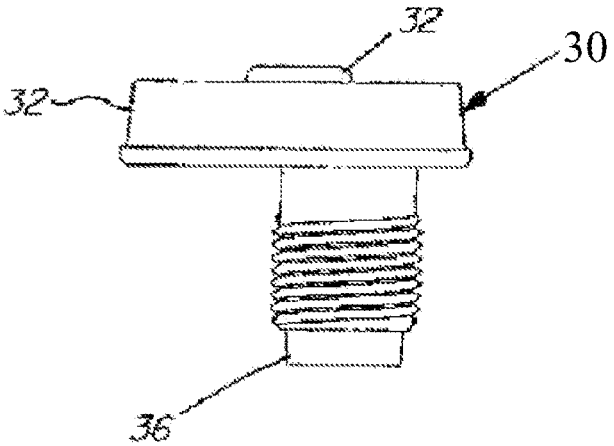
FIG. 4B is a side elevation view of the face plate of the film pack container shown in FIGS. 2 and 3.
Figure 5:
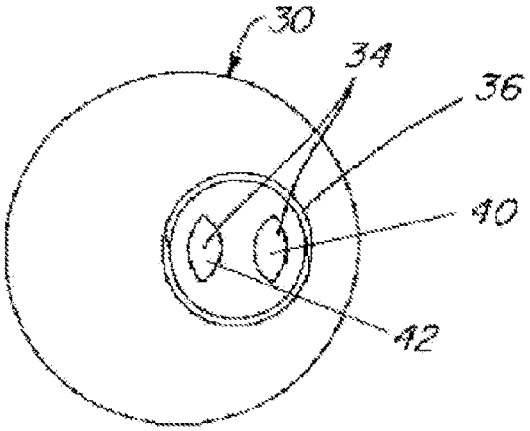
FIG. 5 is a front view of the face plate of the film pack shown in FIGS. 2 and 3.

As shown in FIGS. 4A, 4B, and 5, the discharge opening 34 in the face plate 30 allows the contents of the bag 26 to flow through the portion 40, and the contents of the bag 28 flow through the portion 42. The passage through the nosepiece 36 has a partition 48 which maintains the separation of the two streams until they enter the static mixer 50 and which is secured onto the nosepiece 36.

Figure 6:
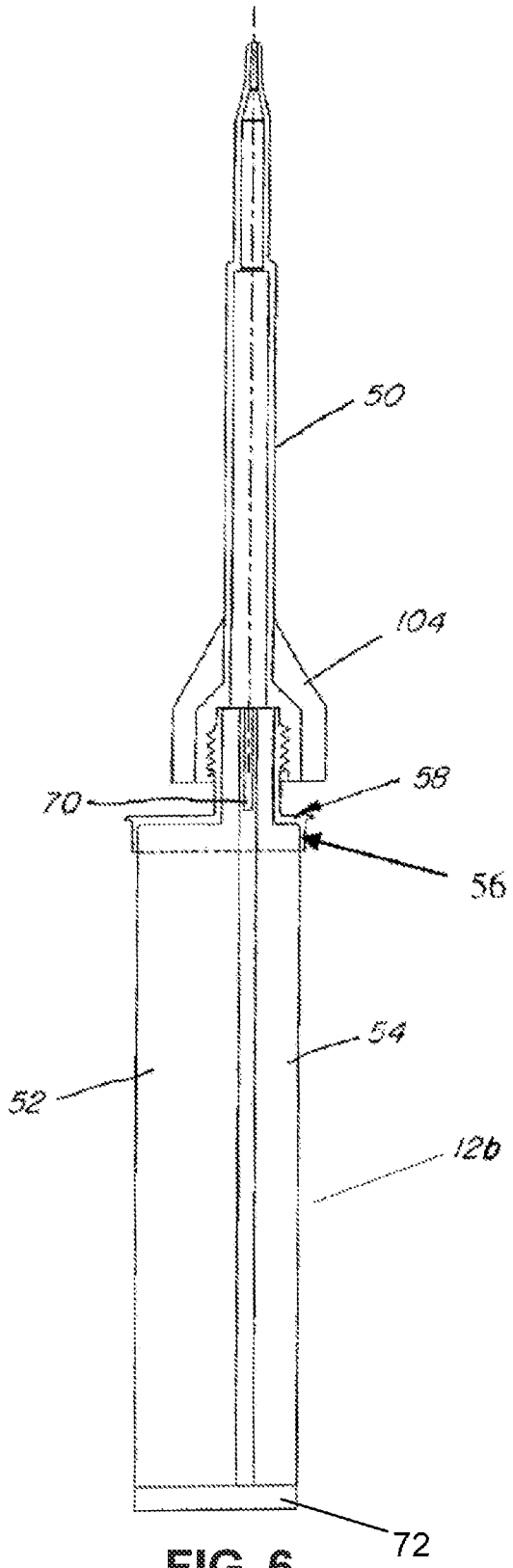
FIG. 6 is a longitudinal sectional view of an alternate embodiment of the film pack container in accordance with an embodiment of the invention.
Figure 7:
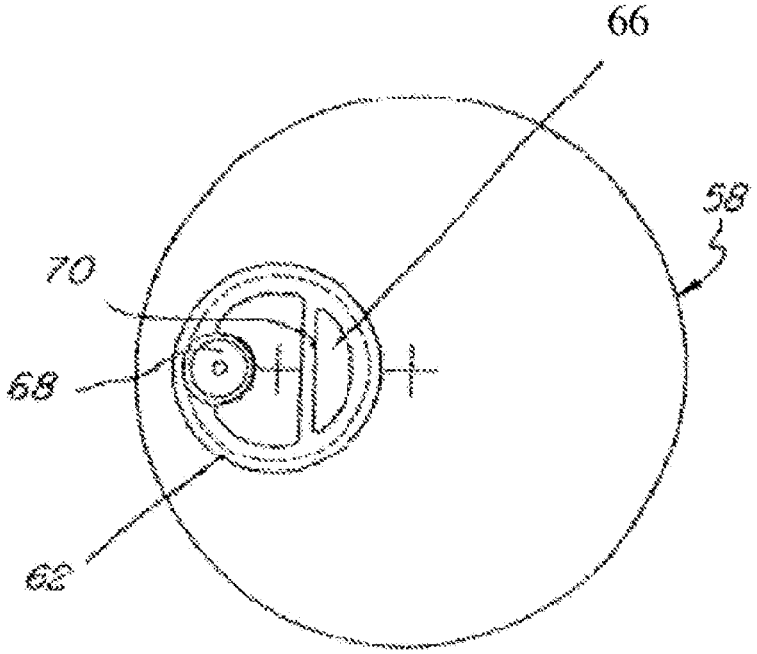
FIG. 7 is a front view of the face plate of FIG. 6.
Figure 8:
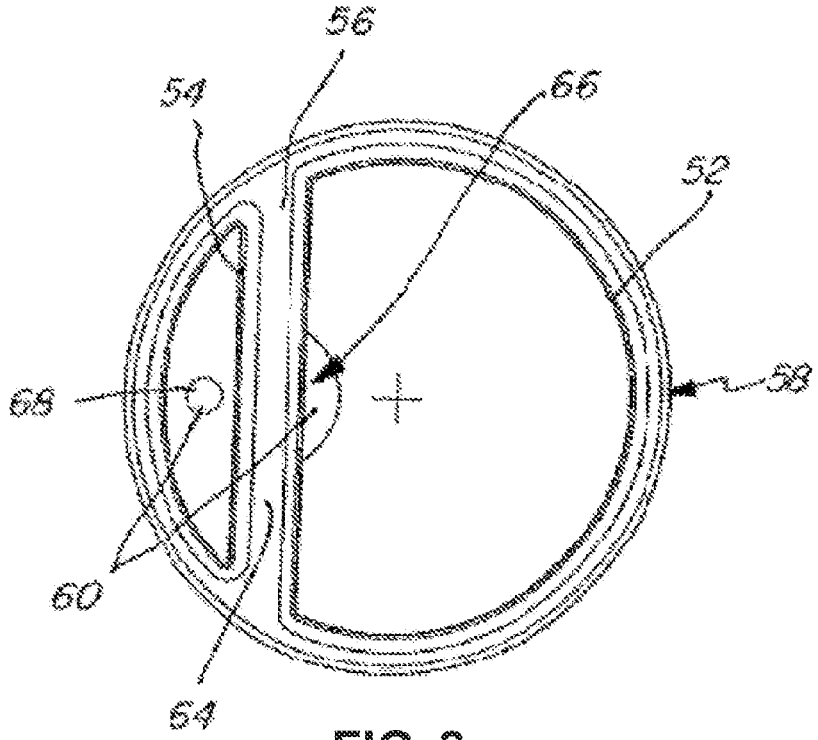
FIG. 8 is a rear view of the face plate of FIG. 6.

Turning next to FIGS. 6-8, the cartridge 12*b* has a pair of generally cylindrical bags 52, 54 having different cross sectional areas (at a ratio of about 3:1). One end of the cylindrical bags 52, 54 is adhered to the flanges 56 of the face plate 58. As in the first embodiment, there is a discharge opening 60 and a nosepiece 62 which extends thereabout. The opening 60 has a partition 64 so that the contents of the bag 52 flow through the portion 66 and the contents of the bag 54 flow through the portion 68. The nosepiece 62 has a cooperating and aligned partition 70, and the opposite ends of the bags are sealed by seals 72.

Figure 9:
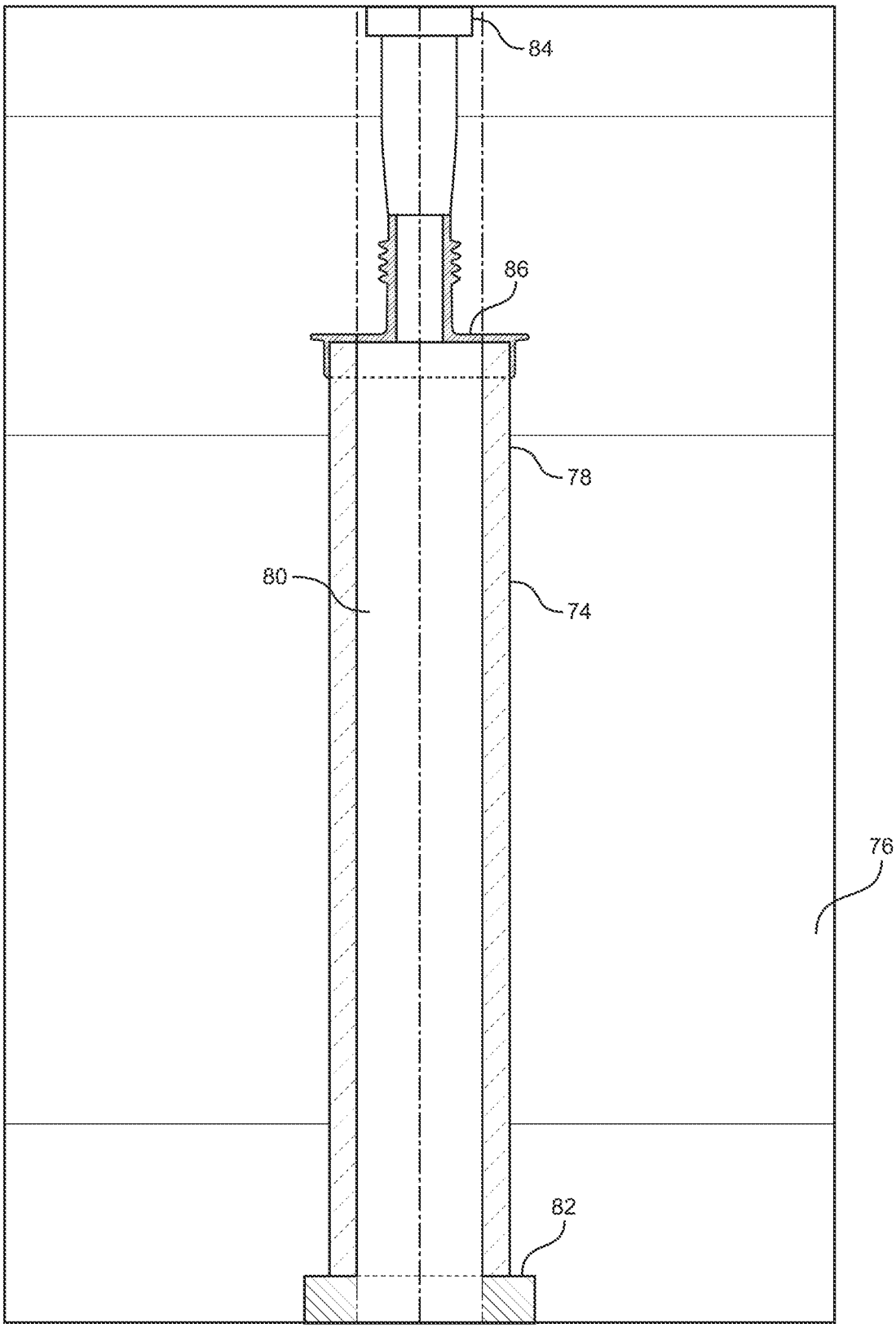
FIG. 9 is a diagrammatic view of film bags mounted on coaxial mandrels and disposed within a mold to form the face plate.

Turning next to FIG. 9, therein schematically illustrated is the mold assembly for integrally molding the face plate 30 about the ends of the coaxial bags 26, 28 and bonding the components in assembly. Seated in a complimentary cavity 74 in a mold 76 are an annular mandrel 78 and a coaxial cylindrical mandrel 80 upon which are slidably supported the annular bag 26 and the cylindrical bag 28. The mandrels 78, 80 are supported on the base 82, and a secondary core 84 extends downwardly to cooperate with the mandrels 78, 80 to provide a cavity portion 86 corresponding to the configuration desired for the face plate 30.

Molten synthetic resin is injected into the cavity portion 86 through runners (not shown) to produce the desired face plate 30 including the flanges 32, discharge opening 34 and nosepiece 36. The molten resin heats the exposed end portions of the bags 26, 28 to effect a strong bond between the bags 26, 28 and face plate 30. After cooling, the mold 76 is opened and the mandrel fixture is withdrawn. The film bags 26, 28 are slid off the mandrels 78, 80 and the opposite ends of the bags are sealed to provide an empty cartridge.

Figure 10:
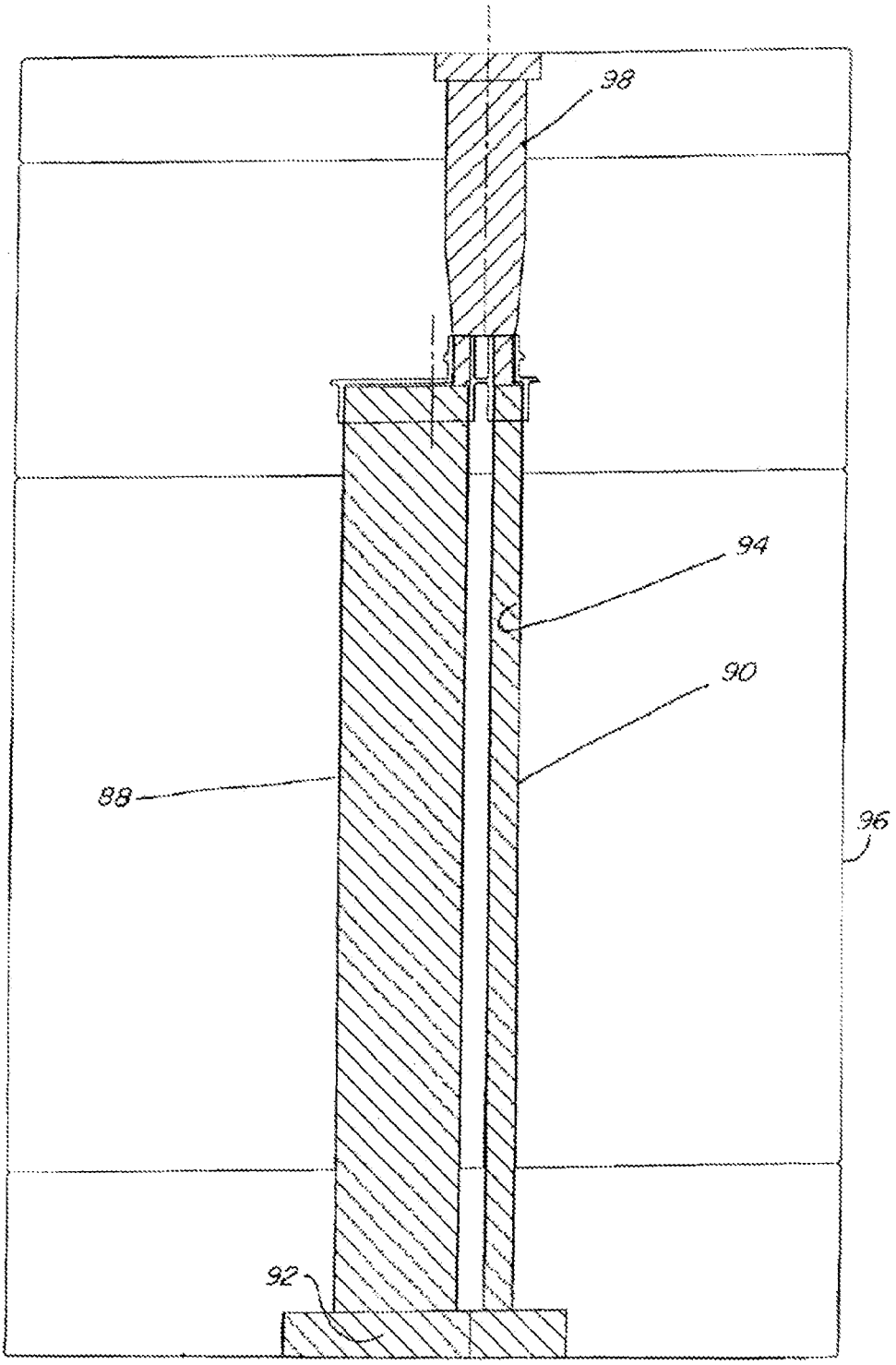
FIG. 10 is a view similar to FIG. 9 for making a film pack container with side-by-side bags.

Turning next to FIG. 10, therein illustrated is the mold assembly for molding and bonding the bags 52, 54 to the face plate 58 for the embodiment of FIGS. 6-8. A large diameter mandrel 88 and a small diameter mandrel 90 are supported on the base 92 and have the bags 52, 54 supported thereon in the cavity 94 of the mold 96. The secondary core 98 cooperates with the mold cavity 94 to provide a cavity portion in which the ends of the bags 52, 54 are exposed so that resin will flow thereabout to form the face plate 58 and bond the components. After cooling, the mandrel assembly is withdrawn from the mold 96 and the face plate and bags are removed therefrom to provide the empty cartridge.

Figure 11:
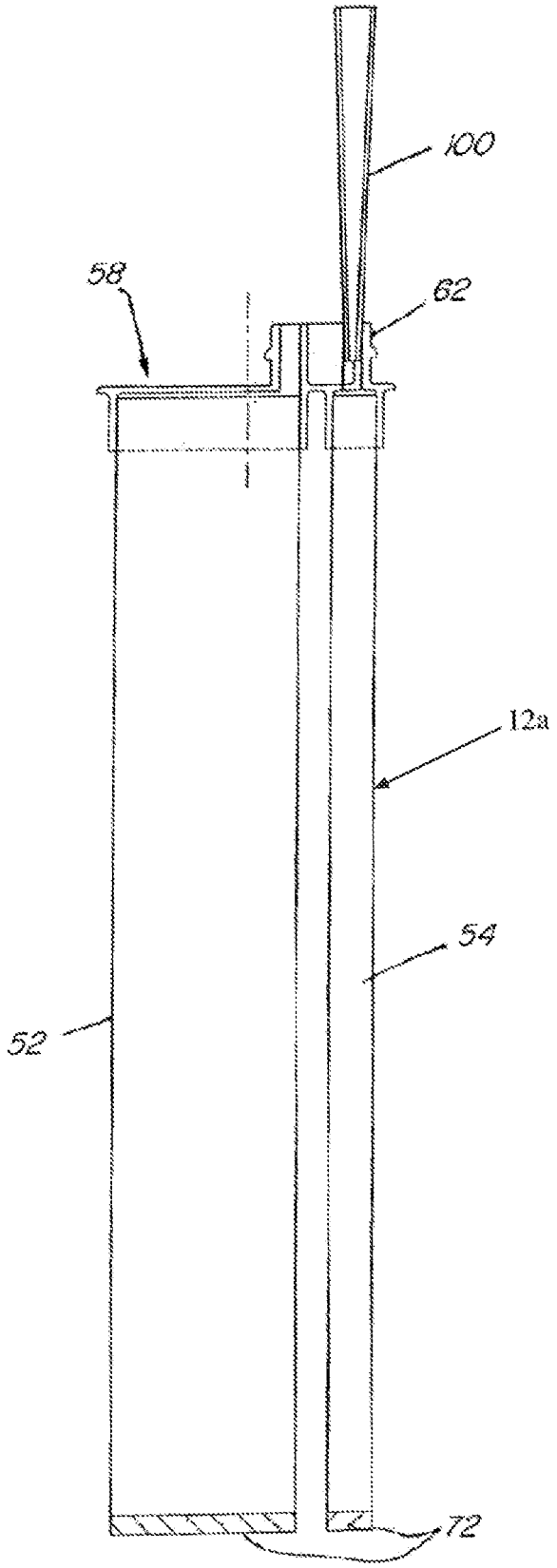
FIG. 11 is a diagrammatic view of the film bag/face plate assembly with a dispenser tube coupled to the face plate for introduction of a flowable composition into one of the bags.
Figure 12A:
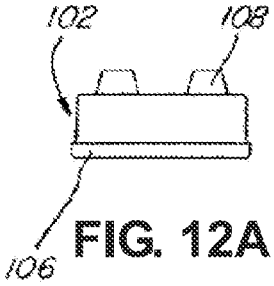
FIG. 12A is a side elevational view of a cap for use in accordance with an embodiment of the invention.
Figure 13A:
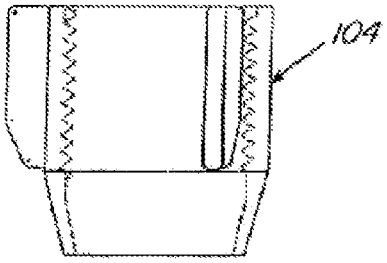
FIG. 13A is a side view of a coupler for use in accordance with an embodiment of the invention.
Figure 12B:
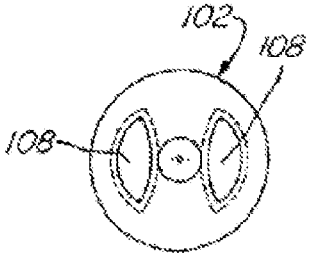
FIG. 12B is a rear elevational view of the cap of FIG. 12A.
Figure 13B:
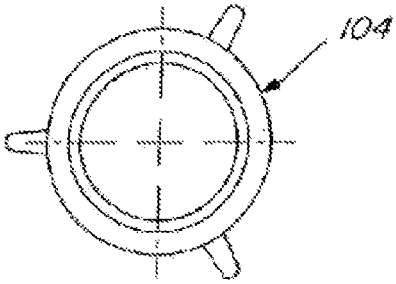
FIG. 13B is a front view of the coupler of FIG. 13A.
Figure 14:
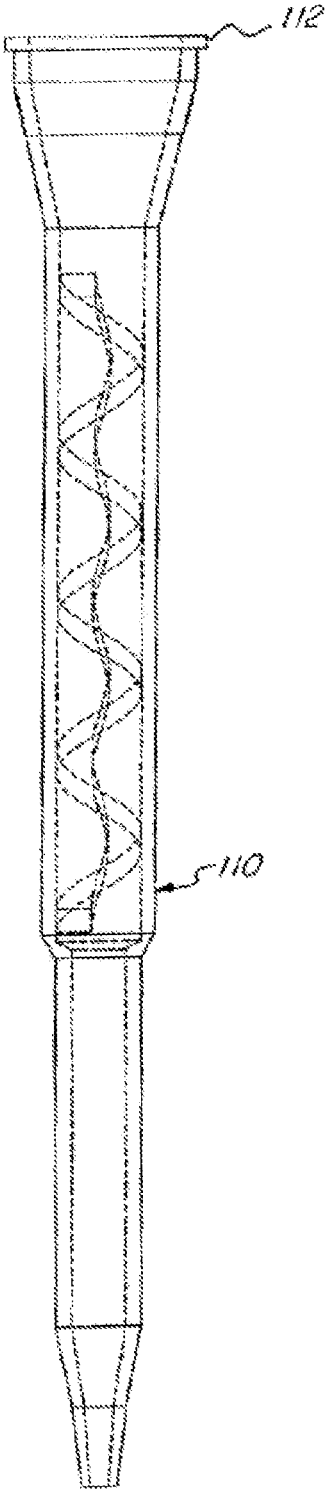
FIG. 14 is a longitudinal view of a static mixer for use in accordance with an embodiment of the invention.
Figure 15:
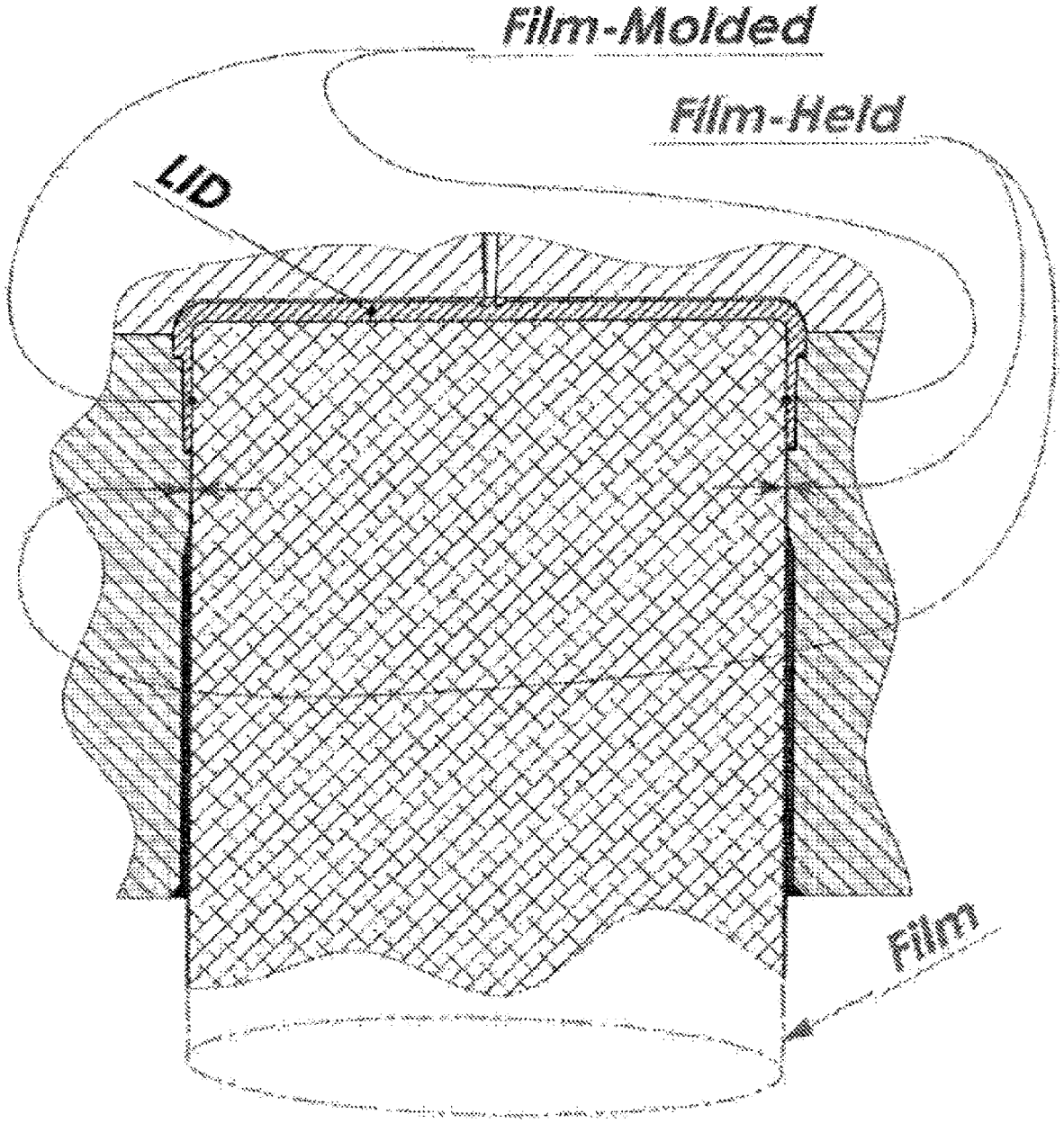
FIG. 15 is a diagrammatic illustration of a mold cavity film and overmolded face plate in accordance with an embodiment of the invention.

Turning next to FIG. 11, an empty cartridge 12*a* is supported on a fixture (not shown), and air is evacuated from the bags 52, 54. A first flowable composition is injected into the small bag 54 through the fill tube 100 which is seated in the face plate 58. Generally, the flowable composition will extend into the nosepiece 62. After the bag 54 is filled, a similar fill tube (not shown) is inserted into the nosepiece 62 and a flowable composition is injected into the large bag 52.

Turning now to FIGS. 12A, 12B, 13A, and 13B, after the bags have been filled, the cap 102 is secured to the nosepiece 62 by the internally threaded coupler 104 which bears against a flange 106 on the cap 102 and threads onto the nosepiece 62. The cap 102 has portions 108 which extend into the nosepiece 62. The coupler 104 also serves to mount the static mixer 110 since the coupler 104 bears against the flange 112 of the mixer 110.

Figure 16:
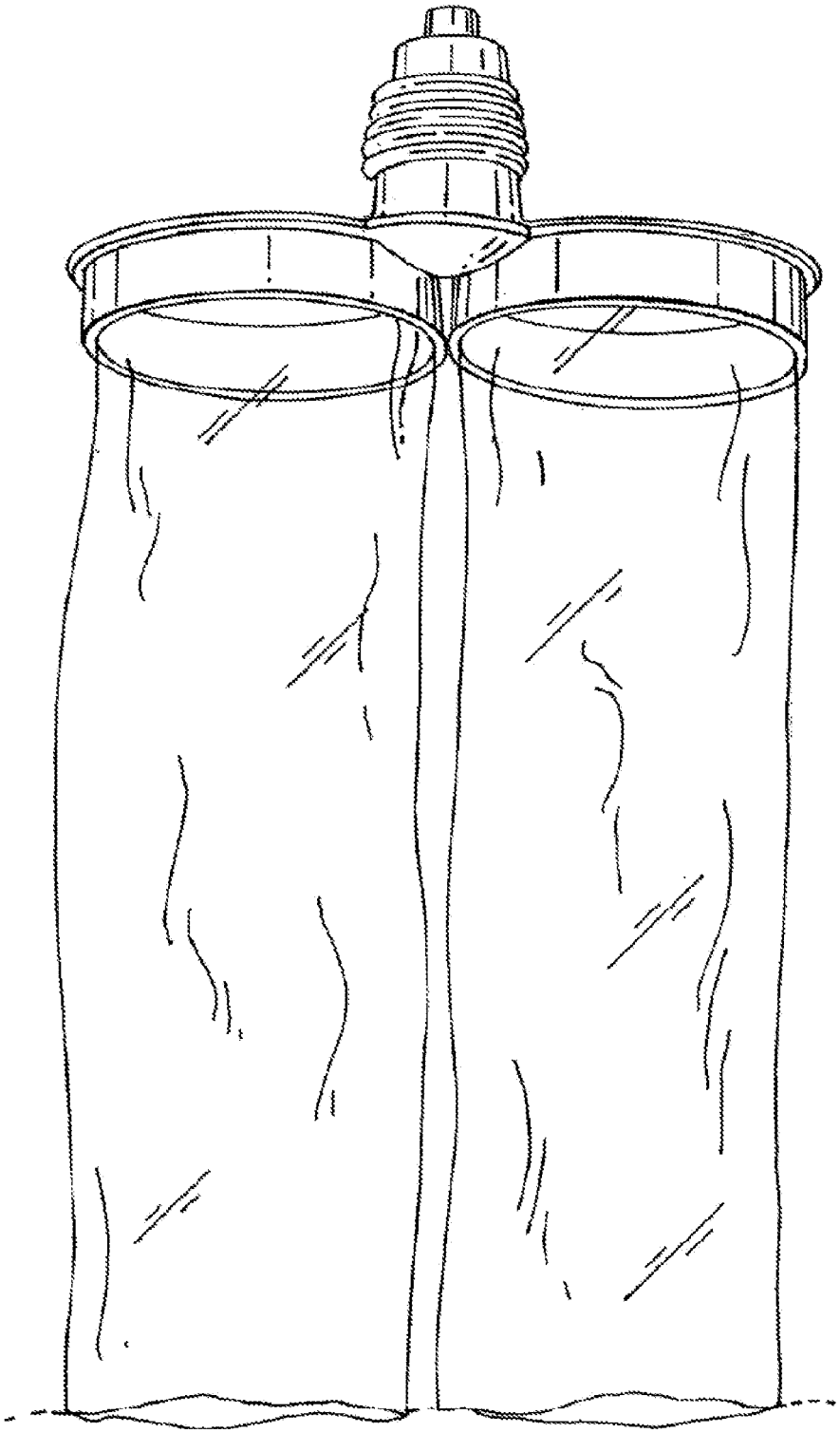
FIG. 16 is a drawing of a dual film bag prior to filling and sealing of the lower end in accordance with an embodiment of the invention.

FIG. 16 is a drawing of a dual film pack cartridge sold commercially by Applicant's assignee. The film packs are side by side and the face plate is disposed about the end of the tubular film bags.

Figure 17A:
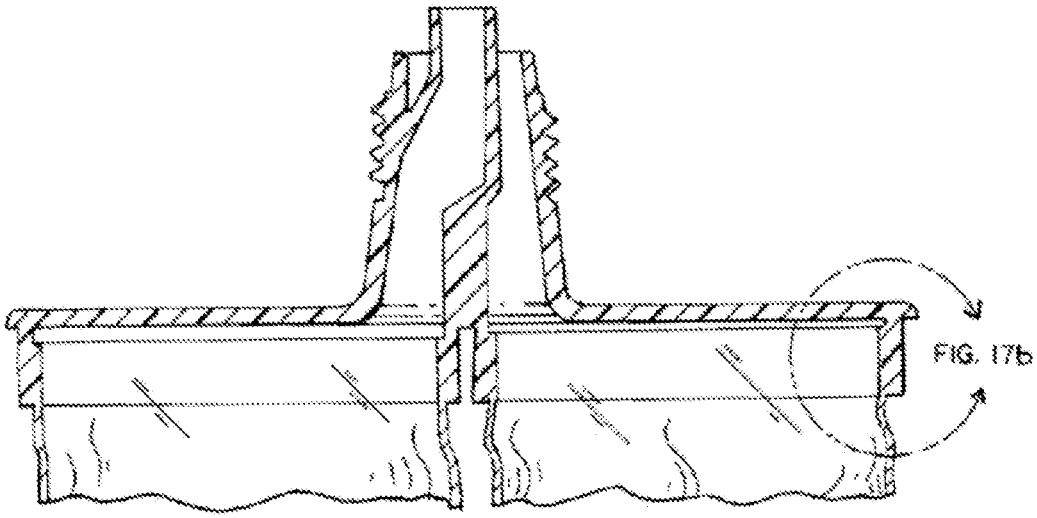
FIG. 17A is a drawing of a fragmentary single bag in accordance with an embodiment of the invention.

FIG. 17A is a drawing of a dual bag and face plate.

Figure 17B:
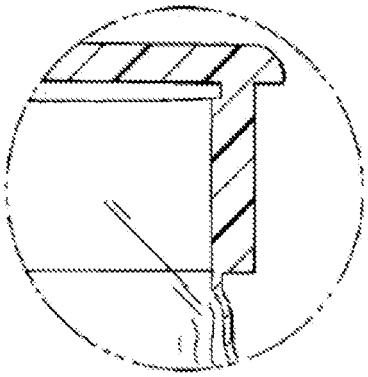
FIG. 17B is a drawing of the fragmentary single bag of FIG. 17A.

FIG. 17B is a drawing of an enlarged fragmentary portion thereof.

Figure 18:
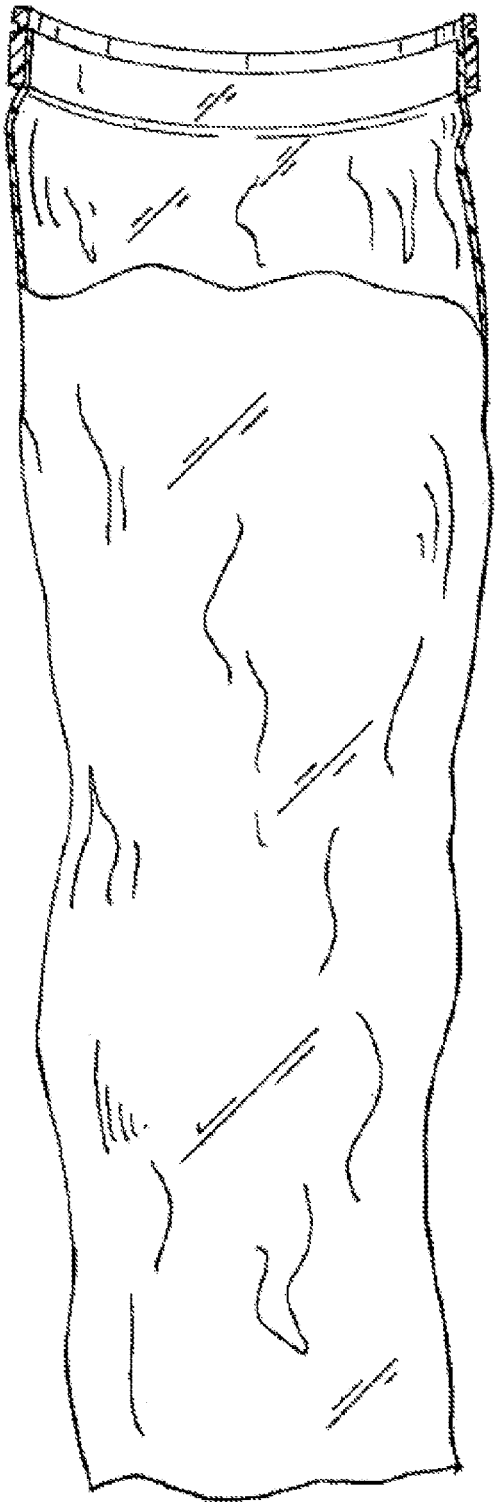
FIG. 18 (PRIOR ART)
FIG. 18 is a drawing of a single bag from what is understood to be a licensee of Konuma and made in accordance with U.S. Pat. No. 5,593,066.

FIG. 18 is a drawing of a single film bag cartridge made in accordance with U.S. Pat. No. 5,593,066.

Figure 19:
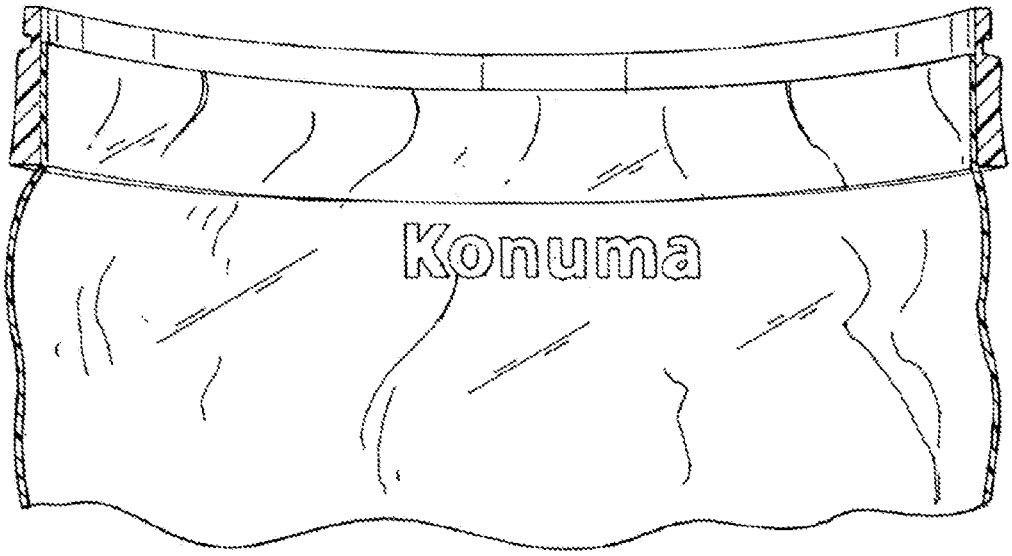
FIG. 19 (PRIOR ART)
FIG. 19 is a drawing of an enlarged fragmentary portion of the film bag of FIG. 18 with a base closure member engaged with the lower end of the tubular film bag.

FIG. 19 is an enlarged fragmentary view of the Konuma bag reinforcing member assembly. The film bag is placed about the periphery of the reinforcing member and is adhered to the outer surface of the reinforcing member.

By supporting the upper ends of the mandrel in a properly configured mold cavity, the molten resin will flow about the upper end of the film bag and cause it to become molten and intermix with the molten resin flowing into the cavity As used herein, the term "discharge" opening includes single partitioned openings and spaced, separate openings. The configuration and size will vary with the volume to flow therethrough and the bag configuration.

As used herein, the term "synthetic resin" includes homopolymers and interpolymers, and various additives including fillers, reinforcing elements, etc. In the instance of the film bags, it includes not only homogenous films but also laminates of different resins with and without additives. A preferred resin is polypropylene but polyethylene and nylon may also be used. For some applications, it is desirable to use a composite film with a center layer of nylon and inner and outer layers of polypropylene.

As used herein, the term "substantially identical" composition refers to resins of similar chemistry which will bond strongly. In the instance of laminates, the resin layer providing the surface of the bag to be bonded to the face plate should be substantially identical to that the resin of the face plate so that the bag will firmly bond thereto.

The film bags are generally formed from tubular film cut to the desired length. Although blown film is preferable, flat film may be formed into a tube with bonded overlapping edges. Bonding of the ends of the bags remote to the face plate can be effected by adhesives, heat, sonic welding, and other readily available techniques. Applicant's process of overmolding the face plate on the exterior of the film eliminates secondary operations with premolded members. It can be seen that the present process permits use of bags of laminated films including one or more resins providing desired properties such as resistance to attack by the contents better bonding and mixing of the resins of the film and face plates.

In contrast, microscopic analysis of the film/reinforcing member of Konuma shows multiple defined layers whereas the overmolding of the present invention produces an integrated structure of essentially uniform composition in which the bag is disposed inwardly of the face plate and there are no distinct layers at the interface.

Various flowable compositions may be used in the film packs including sealants, adhesives, protectants, paints and other coating materials, foams, etc. The film exposed thereto and the face plate should have a composition which will not be adversely affected thereby. The mixed components exiting the static mixer can be applied directly or sprayed by use of a pressurized air source and a suitable nosepiece assembly.

The dimensioning (cross sectional area) of the bags in a film pack will allow proportionating the two components to be mixed. For a 1:1 ratio, the bags have the same cross sectional area. For a 3:1 ratio, one of the bags will have a cross sectional area which is three times that of the other. When the relative viscosity of the compositions or the ratios warrants, the discharge openings may also be customized to facilitate or retard flow therethrough.

The discharge opening may assume several different configurations but should provide partitioning of the flowable compositions until after they have passed into the nosepiece. Moreover, the configuration and dimensioning of the separate portions may provide a restriction for one of the flowable compositions to accommodate variation in viscosity, different ratios, etc.

The dispensers conveniently use as sleeves cylindrical tubes of synthetic resin, spiral wound paperboard, metal and laminates which can be reused. By use of shuttles acted on by the pusher of the piston, the shuttles are moved in the sleeve against the bags to compress them. When the film packs are only partially discharged, the static mixer can be removed and discarded, and the cap is placed on the nosepiece. If the contents are fully discharged, the static mixer is removed and the film pack can be removed from the sleeve; both are discarded. A new film pack can be placed in the sleeve which is rotated end for end before placement in the dispenser. Thus, the shuttle is at the opposite end of the dispenser to be acted upon by the pusher of the piston when the sleeve and cartridge are placed in the dispenser. Thus, the discharged film pack cartridges and static mixers are discarded, but the dispensers, sleeves and shuttles are all reusable. As such, it can be seen from the foregoing detailed description and attached drawings that the film bag cartridges of the present invention are relatively simple to fabricate and the components are bonded to provide good sealing. The bags can be filled easily after assembly of the components.

Figure 20:
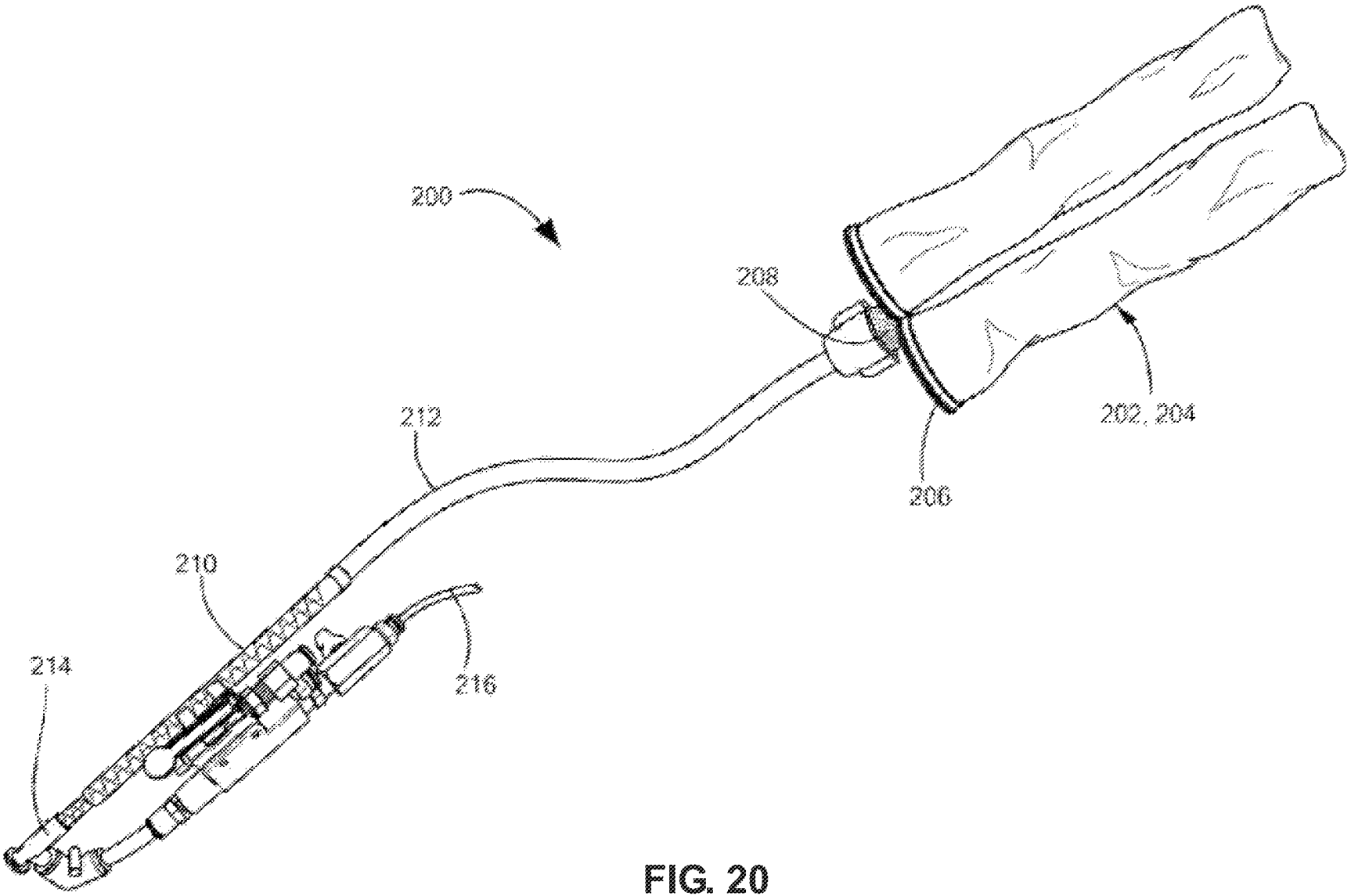
FIG. 20 depicts a first portion of a component delivery system utilizing film bags in accordance with an embodiment of the invention.

Turning now to FIGS. 20-25, alternative component delivery systems that utilize the aforementioned film bags are depicted. FIG. 20 depicts a first portion 200 of a component delivery system that utilizes two flexible film bags 202, 204 (similar to film bags 26, 28). The two flexible film pack bags 202, 204 have a common rigid face plate 206 (similar to face plate 30) with a discharge nosepiece 208 (similar to nosepiece 36) integrally formed therewith. The discharge nosepiece 208 has a partition (best seen with reference to partition 48 in FIG. 3) internally disposed and configured to maintain separate flow streams from respective ones of the two flexible film pack bags 202, 204. A mixer 210 (similar to static mixer 50) is disposed in fluid communication with the flow streams from respective ones of the two flexible film pack bags 202, 204 via a first flexible tube 212 disposed on an upstream side of the mixer 210. In an embodiment, the flexible tube 212 is a single tube that fluidly connects the mixer 210 to the nosepiece 208, and can be of any length suitable for a purpose disclosed herein, which typically would be a length limited by the potting time of the two components from the two film bags 202, 204 as they travel, and partially mix while they travel, through the flexible tube 212. In an embodiment, a material applicator 214, such as a spray tip for example, is disposed in fluid communication with and on a downstream side of the mixer 210. A second flexible tube 216 (depicted as a partial length in FIG. 20) is disposed in fluid communication with the material applicator 214 for supplying atomization air to the material applicator 214 via pressurized gas.

Figure 21:
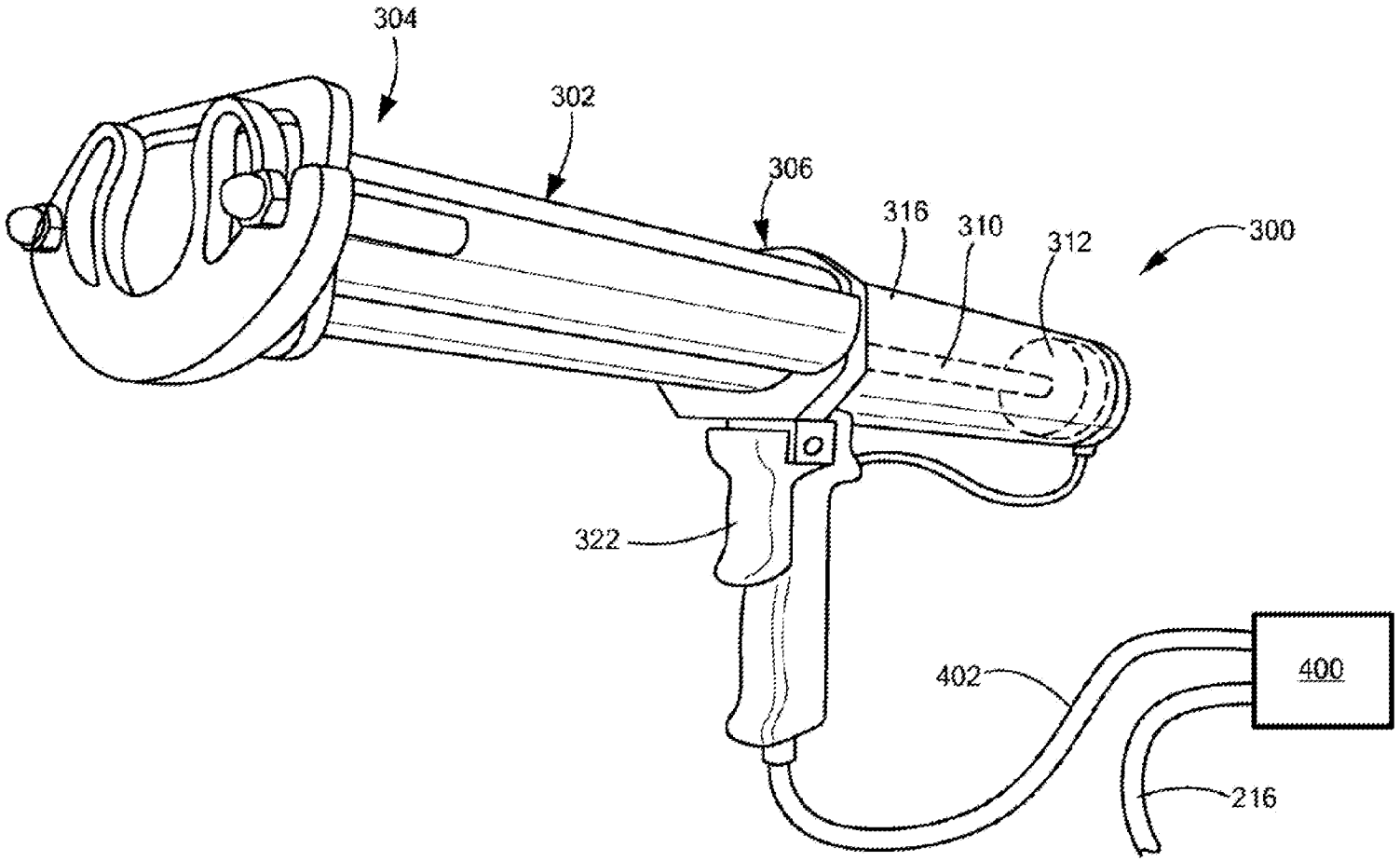
FIG. 21 depicts a second portion of the component delivery system in accordance with an embodiment of the invention.
Figure 24:
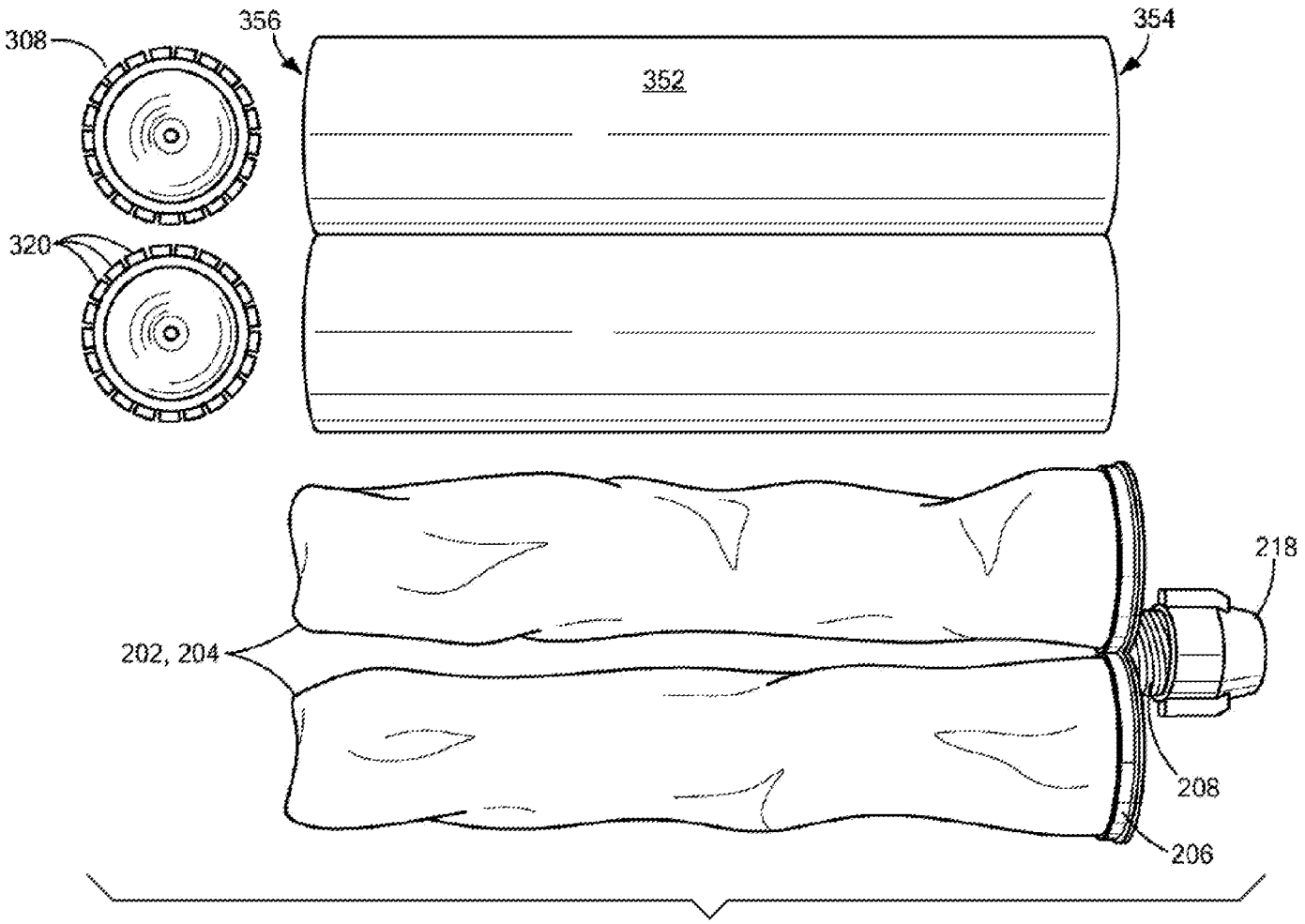
FIG. 24 depicts an alternative arrangement of sleeves, film bags and shuttles, in accordance with an embodiment of the invention.

FIG. 21 depicts a second portion 300 of the component delivery system. In an embodiment, the second portion 300 includes two side-by-side cylindrical sleeves 302 (only one visible in FIG. 21) each having a front end 304 and a back end 306, two shuttles 308 (best seen with reference to FIG. 24) (similar to shuttle 24) are slidingly disposed internal of and proximate the back end 306 of respective ones of the two cylindrical sleeves 302. The two cylindrical sleeves 302 are substantially rigid as compared to the flexible film bags 202, 204, and can be of any material suitable for a purpose disclosed herein, such as aluminum as depicted in FIG. 21, or plastic as depicted in FIG. 24, which is discussed further below. Two side-by-side push rods 310 (only one visible in FIG. 21) are disposed in operable communication with respective ones of the two shuttles 308, and driven by a piston 312 that is disposed in operable communication with the two push rods 310. Pressurized gas 400 is utilized to drive the piston 312 via a pressurized gas line 402. Flow of the pressurized gas 400 is controlled via a trigger 322. In an embodiment, the pressurized gas 400 is provided by an air compressor for example. The piston 312 has a piston housing 316, and the two cylindrical sleeves 302 are fixedly attached to the piston housing 316. Another end of the second flexible tube 216 is depicted in FIG. 21 connected to the same source of pressurized gas 400. As best seen with reference now to FIG. 22, the front ends 304 of respective ones of the two cylindrical sleeves 302 are configured and adapted to receive individual ones of the two flexible film pack bags 202, 204, which are inserted into the front end 304 of the sleeves 302. In an embodiment, a holder 314 is disposed proximate the front end 304 of respective ones of the two cylindrical sleeves 302 and is configured and adapted to restrain the face plate 206 during dispensing of the flowable material inside the two film pack bags 202, 204. The holder 314 is securable to the two cylindrical sleeves 302 via hardware 318, and movable with respect thereto, pivotable for example, to facilitate loading of the film bags 202, 204 into the two cylindrical sleeves 302.

Figure 23:
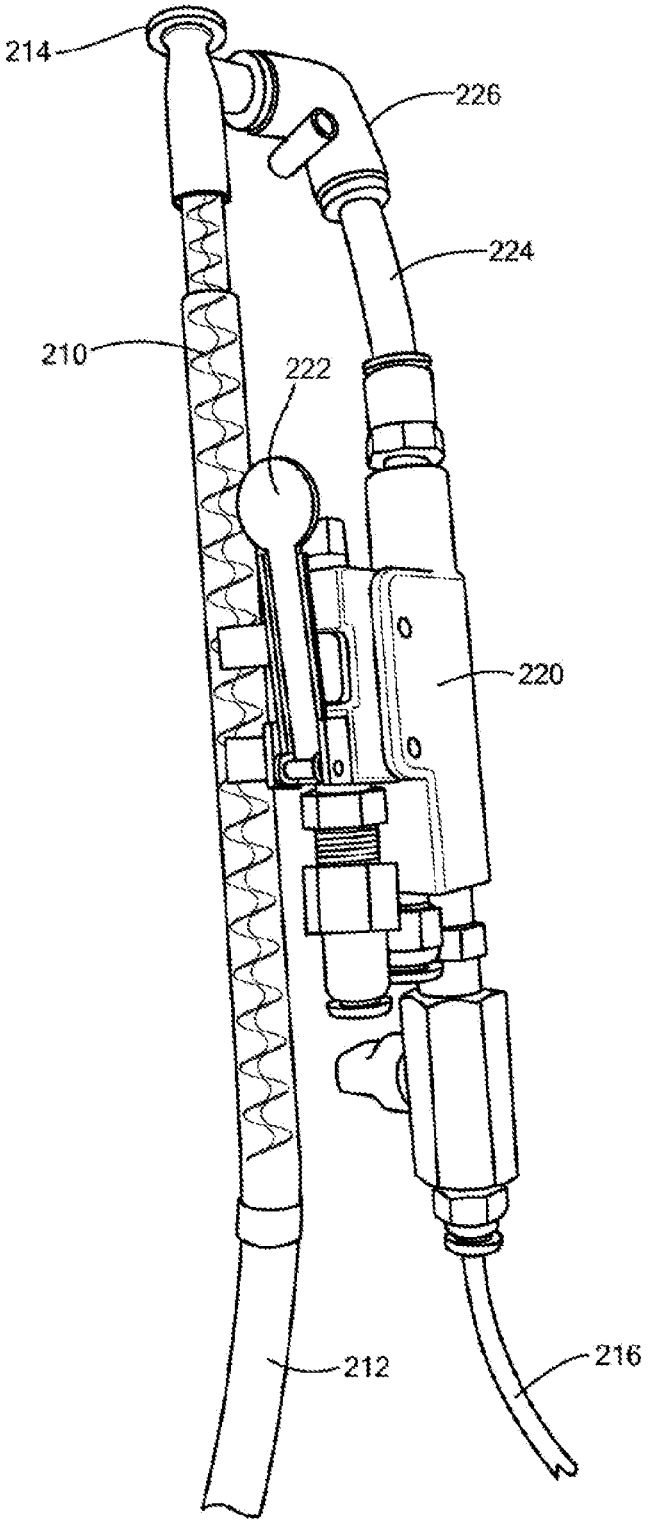
FIG. 23 depicts an enlarged view of the mixing and dispensing section of the first portion of the component delivery system in accordance with an embodiment of the invention.

Reference is now made to FIG. 23, which depicts an enlarged view of the mixing and dispensing section of the first portion 200 of the component delivery system in accordance with an embodiment of the invention. The flowable material from the film pack bags 202, 204 when dispensed via the second portion 300 travel through the flexible tube 212 and through the mixer 210 to the material applicator 214 (spray tip for example). Atomization air from the pressurized gas 400 is provided to a trigger assembly 220 via the flexible tube 216. Actuation of a trigger switch 222 permits the pressurized gas to travel through the connecting tube 224 and the coupling 226 to provide atomization air at the material applicator 214. In an embodiment where the material applicator 214 is a spray tip, the atomization air facilitates spraying of the flowable material, and the flexible tube 216 facilitates spraying in close quarters, such as below ground through a manhole cover for example.

Figure 22:
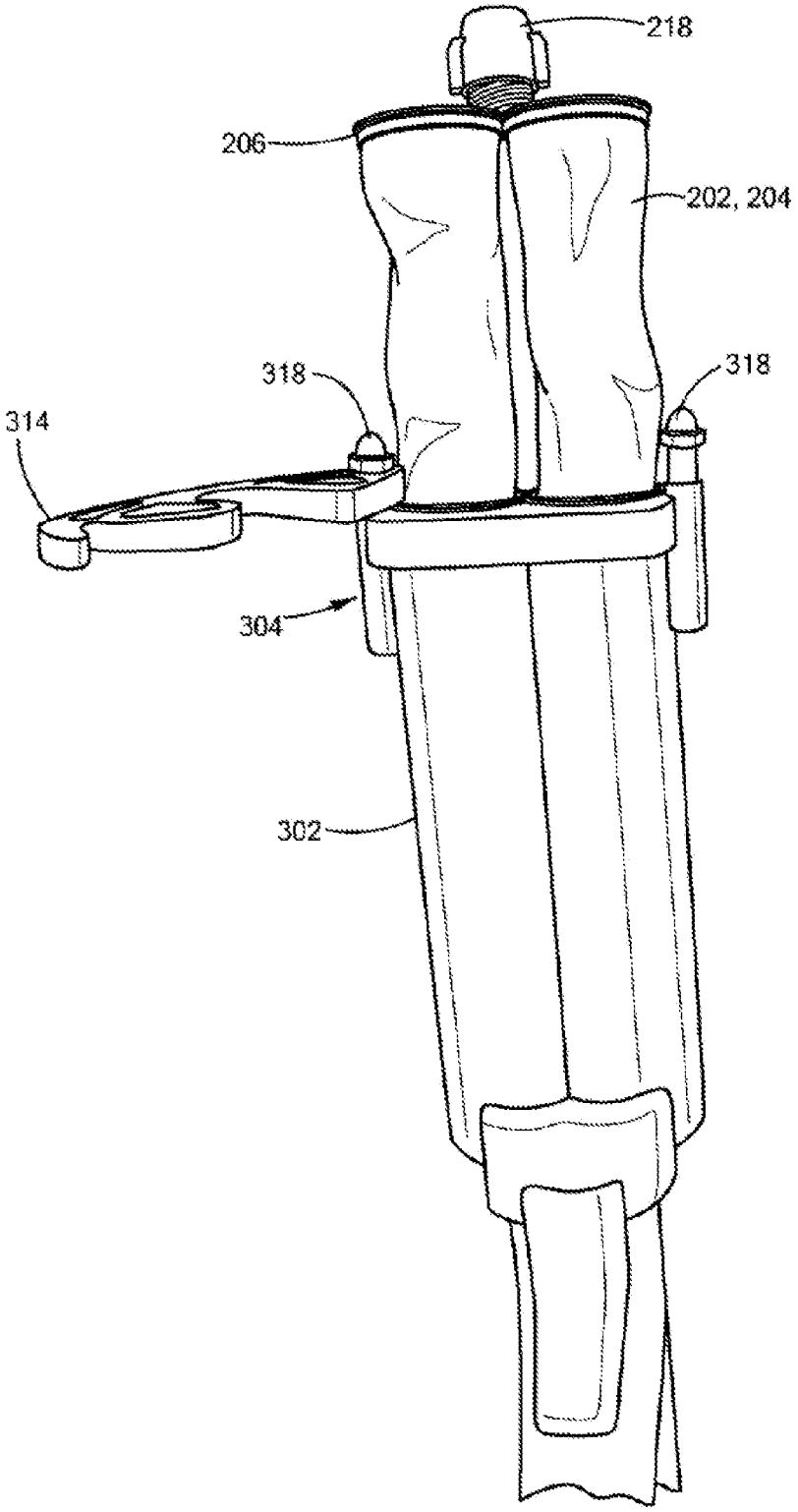
FIG. 22 depicts a partially assembled state of the film bags of the first portion partially installed into sleeves of the second portion of the component delivery system in accordance with an embodiment of the invention.

As mentioned above, the two cylindrical sleeves 302 can be made from any material suitable for a purpose disclosed herein. In FIGS. 21 and 22, example cylindrical sleeves 302 were made from aluminum. With reference now to FIG. 24, an alternative arrangement of two cylindrical sleeves 352, film bags 202, 204, and shuttles 308 is depicted, where the two cylindrical sleeves 352 are made from plastic. Assembly of the film bags 202, 204 into the sleeves 352 is similar to that discussed in connection with FIG. 22, where the two shuttles 308 are inserted into the back ends 356 of the sleeves 352, while the film bags 202, 204 are inserted into the front ends 354 of the sleeves 352. The combination of the film bags 202, 204 in the cylindrical sleeves 352 acts like the film bag cartridge 12 and sleeve 22 in FIG. 1, where the sleeves 352 are also reusable and the expended film bags 202, 204 are disposable. When the combination is assembled into a cartridge form via the sleeves 352, and the film bags 202, 204 are filled with flowable material, a sealing cap 218 is placed over the nosepiece 208 to prevent leakage and premature curing of the flowable material inside the film bags 202, 204.

Figure 25:
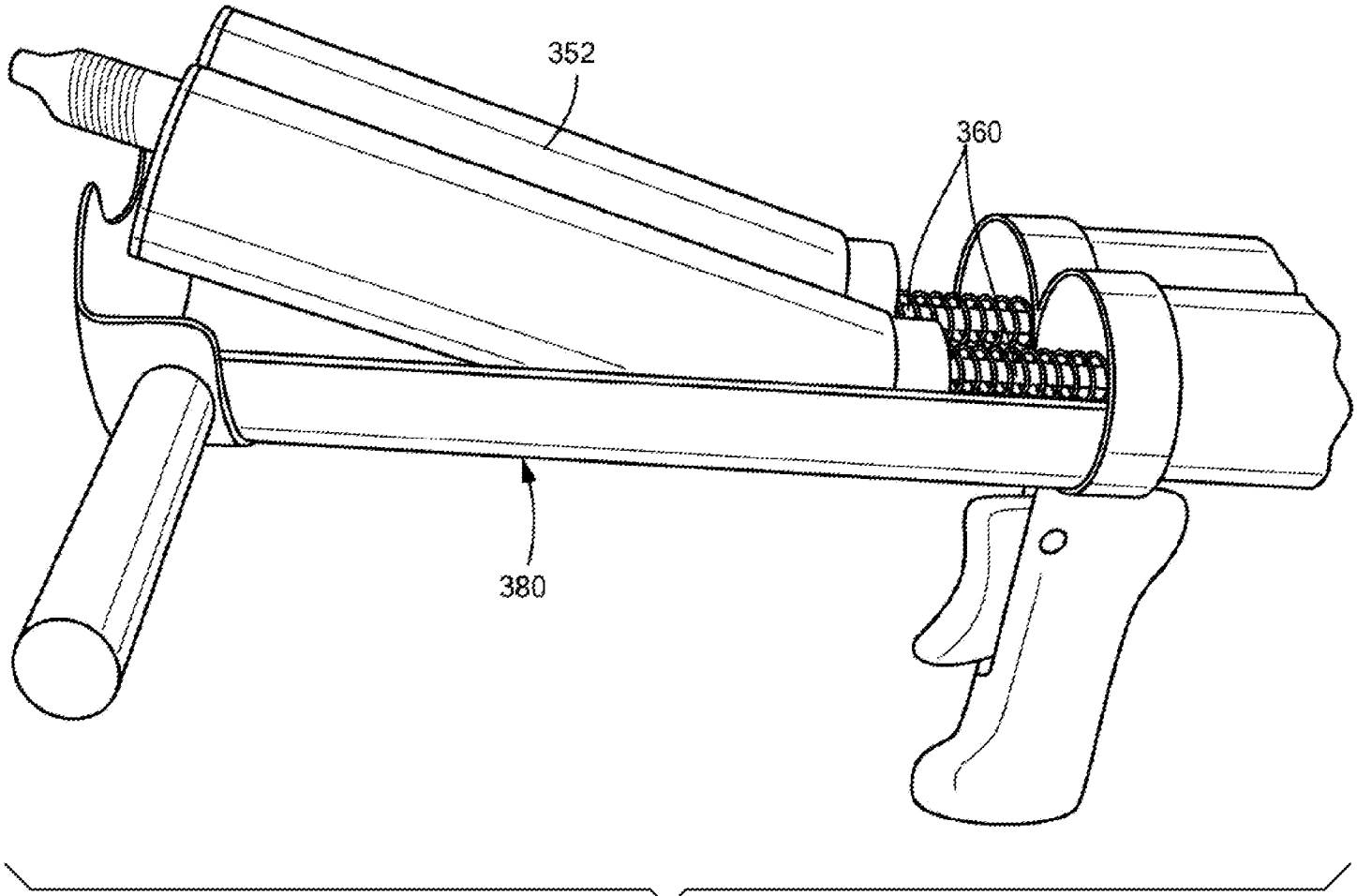
FIG. 25 depicts the alternative sleeves of FIG. 24 being utilized in a cartridge dispenser similar to that depicted in FIG. 1.

To facilitate dispensing of the flowable material from the film bags 202, 204 in the sleeves 352, and with reference now to FIG. 25, a caulking gun type dispenser 380 suitable for dispensing flowable material from a cartridge is employed (similar to the caulking gun 10 in FIG. 1). Similar to the dispensing action discussed above in connection with FIG. 21, the shuttles 308 inside sleeves 352 are driven by two push rods 360, which are driven by a piston (similar to piston 312 for example), which in turn is driven by pressurized gas 400.

With reference now back to FIG. 24, each shuttle 308 has a shape similar to that of a cylindrical disk with an outer cylindrical circumference, and a plurality of individual flexible fingers 320 disposed around the outer circumference. When the shuttles 308 are assembled into their respective sleeves 302, 352, the plurality of flexible fingers 320 of each shuttle 308 flex radially inward in a non-sealing sliding engagement with an interior cylindrical surface of each respective sleeve 302, 352. Spacing between adjacent ones of the flexible fingers 320 permits trapped air inside the sleeves 302, 352 (i.e., between the shuttles 308, sleeves 302, 352, and film bags 202, 204) to escape during a dispensing operation.

Figure 27A:
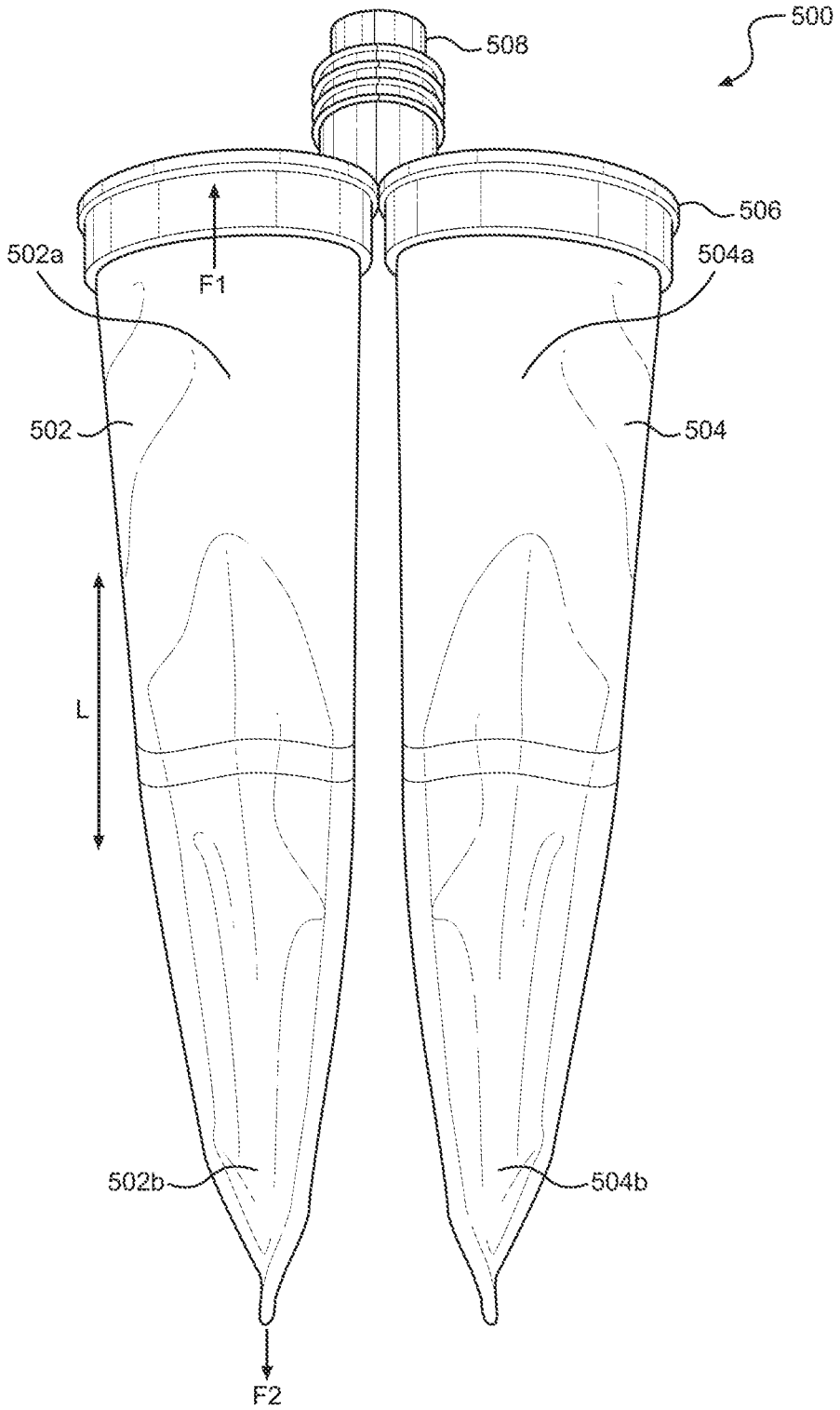
FIG. 27A depicts a film pack including two film bags in a taut state in accordance with an embodiment of the invention.
Figure 27B:
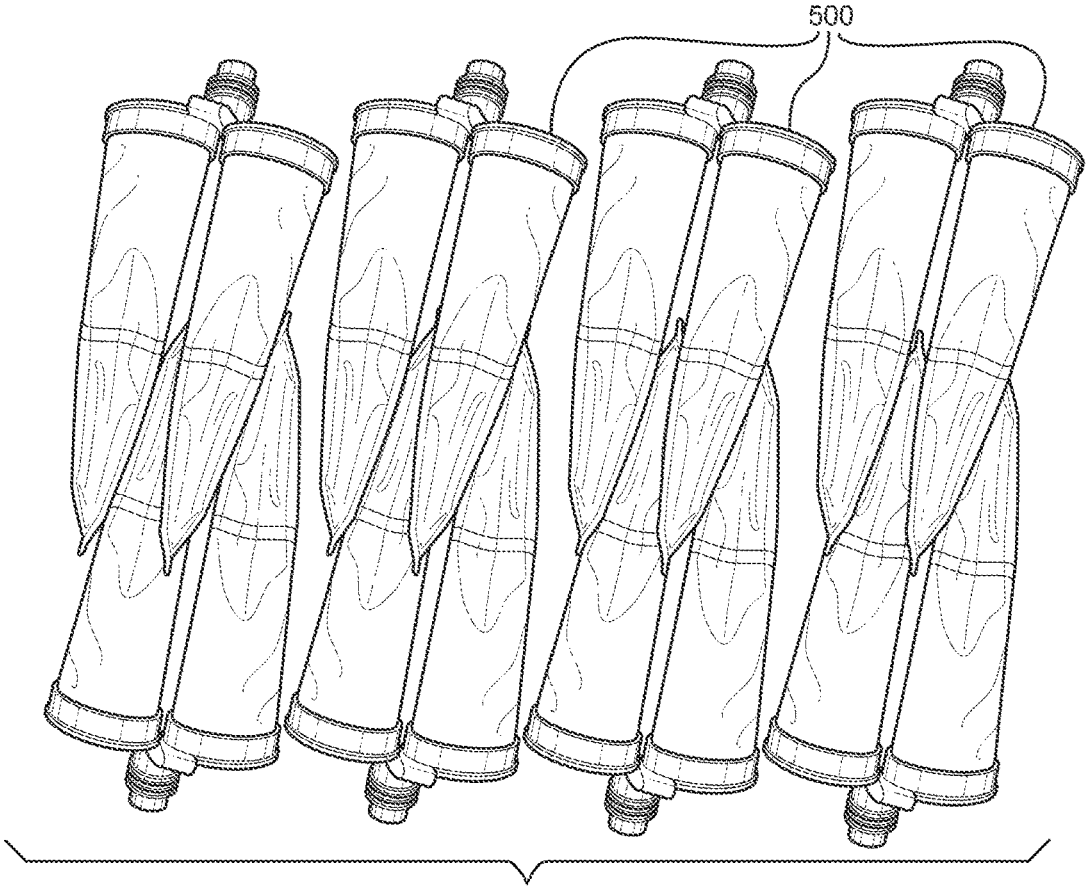
FIG. 27B depicts multiple film packs in the taut state shown in FIG. 27A arranged for transportation.
Figure 28:
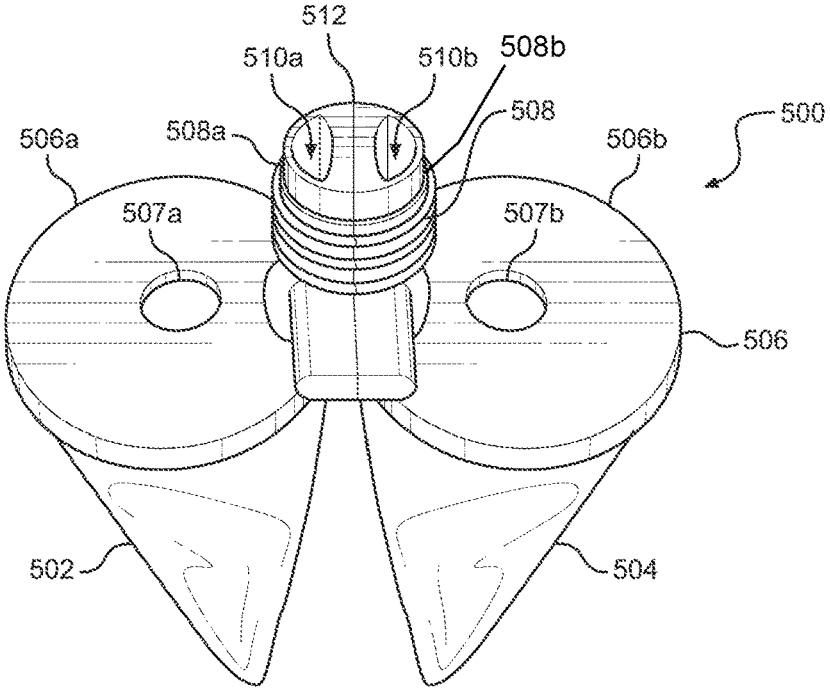
FIG. 28 depicts a top perspective view of the film pack shown in FIG. 27A.

Continuing with FIGS. 27A-28, a film pack 500 in accordance with the present invention comprises a pair of flexible film bags 502, 504. Each of the film bags 502, 504, can be similar to the film bags 26, 28, as well as the film bags 202, 204, as discussed above. The flexible film bag 502 defines a proximal end **502*a* and a distal end 502*b* opposite the proximal end 502*a* along a longitudinal direction L. Likewise, the film bag 504 defines a proximal end 504*a* and a distal end 504*b* opposite the proximal end 504*a* along the longitudinal direction L. The film bags 502, 504 can be coupled through a rigid face plate 506 that can be similar to the face plates 30 and 206, as previously described. When assembled, the a first portion 506*a* of the face plate 506 attaches to the proximal end 502*a* of the film bag 502, and a second portion 506*b* of the face plate 506 attaches to the proximal end 504*a* of the film bag 504. The first portion and second portions 506*a*, 506*b* of the face plate 506 can be releasably coupled to each other. Each of the film bags 502, 504 can comprise a substantially flexible monolayer or multilayer material. For example, each of the film bags can comprise any flexible polymer or metal. In a multilayer configuration, the wall of the film bags 502, 504** can include an outer layer and an inner layer that comprises a first material, such as a polymer. Additionally, a central layer that comprises a second material, such as a metal, can be bounded by the inner and outer layers of the first material.

The face plate 506 can define a nosepiece 508 that extends proximally from the face plate 506 opposite the film bags 502, 504. The nosepiece 508 can be similar to the nosepiece 36 or 208, as previously discussed above. Like the face plate 506, the nosepiece 508 can define a first portion 508*a* and a second portion 508*b* releasably coupled to the first portion 508*a*. The nosepiece 508 can include a partition 512 internally disposed and configured to maintain separate flow streams from respective ones of the two flexible film bags 502, 504. The partition 512 can be partially defined by both the first and second portions 508*a*, 508*b* of the nosepiece 508 and can function to separate a first discharge opening 510*a* from a second discharge opening 510*b*, where each of the first and second discharge openings 510*a*, 510*b* extend through the nosepiece 508. When the film pack 500 is assembled, a first flowable composition can flow from the film bag 502 through the first discharge opening 510*a*, and a second flowable composition that may be the same or different than the first flowable composition can flow from the film bag 504 through the second discharge opening 510*b*. The nosepiece 508 can attach to a static mixer, such as the mixer 210 described above, for mixing the first and second flowable compositions.

As shown in FIG. 28, the first portion 506*a* of the face plate 506 can define a first fill port 507*a* and the second portion 506*b* of the face plate 506 can define a second fill port 507*b* spaced from the first fill port 507*a*. The first fill port 507*a* can be centered over and in fluid communication with the film bag 502, while the second fill port 507*b* can be centered over and in fluid communication with the second film bag 504. The first and second fill ports 507*a*, 507*b* can be utilized in a filling operation for filling the film bags 502, 504, as will be discussed further below.

Figure 29A:
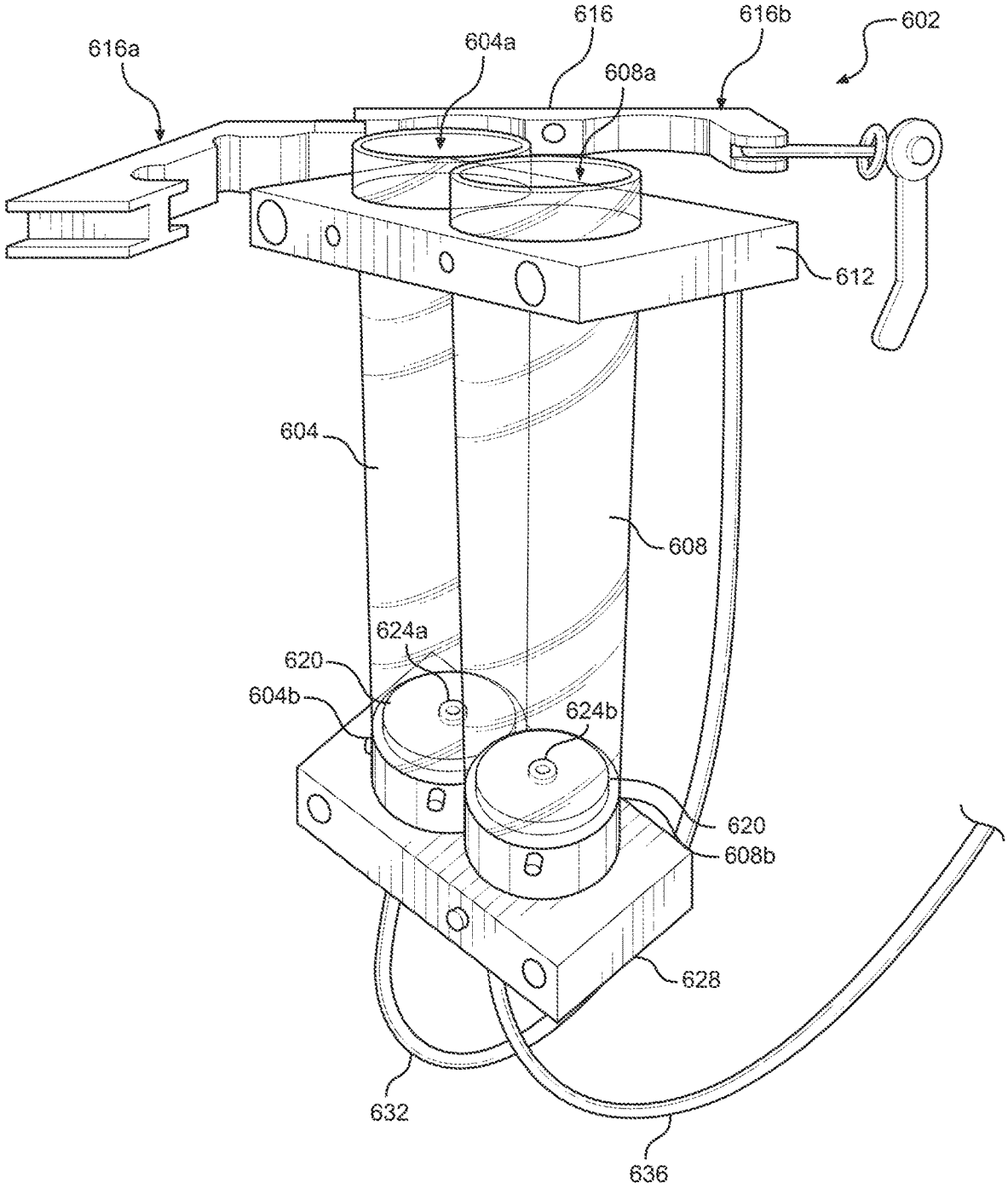
FIG. 29A depicts a fill system for filling the film bags of a film pack in accordance with an embodiment of the invention.

Continuing with FIGS. 29A-30, a fill system 600 for filling the flexible film bags 502, 504 of the film pack 500 will be described. The fill system 600 can include vacuum device 602 for expanding the film bags 502, 504 prior to filling. The vacuum device 602 can include a first chamber 604 and a second chamber 608 adjacent to the first chamber 604. Each of the first and second chambers 604, 608 is configured to receive a respective one of the film bags 502, 504. Each of the first and second chambers 604, 608 can define a substantially cylindrical shape, though other designs are also contemplated. The first chamber 604 extends from a first end 604*a* to a second end 604*b*, while the second chamber 608 extends from a first end 608*a* to a second end 608*b*. The fill system 600 can include a plate 612 that attaches to the first ends 604*a*, 608*a* of the first and second chambers 604, 608 to fixedly couple the first and second chambers 604, 608 together. However, it is also contemplated that the first and second chambers 604, 608 can be manufactured to form a unitary structure. In one embodiment, the vacuum device 602 can include a locking plate 616 above the plate 612 for releasably securing the film pack 500 within the vacuum device 602. In the depicted embodiment, the locking plate 616 can include a first locking section 616*a* and a second locking section 616*b* rotatably attached to the first locking section 616*a*. The locking plate 616 can provide a sufficient force to secure the film pack 500 within the vacuum device 602 when a vacuum is created within the first and second chambers 604, 608, as will be discussed further below. Alternatively, the locking device can be utilized to secure the vacuum device 602 in place during the process of filling the film bags 502, 504, while the vacuum created in the first and second chambers 604, 608, as described below, holds the film pack 500 in place. However, it is contemplated that the fill system 600 can be devoid of the locking plate 616 and rather utilize the vacuum created within the vacuum device 602 to secure the film pack 500 within the vacuum device 602.

Figure 29B:
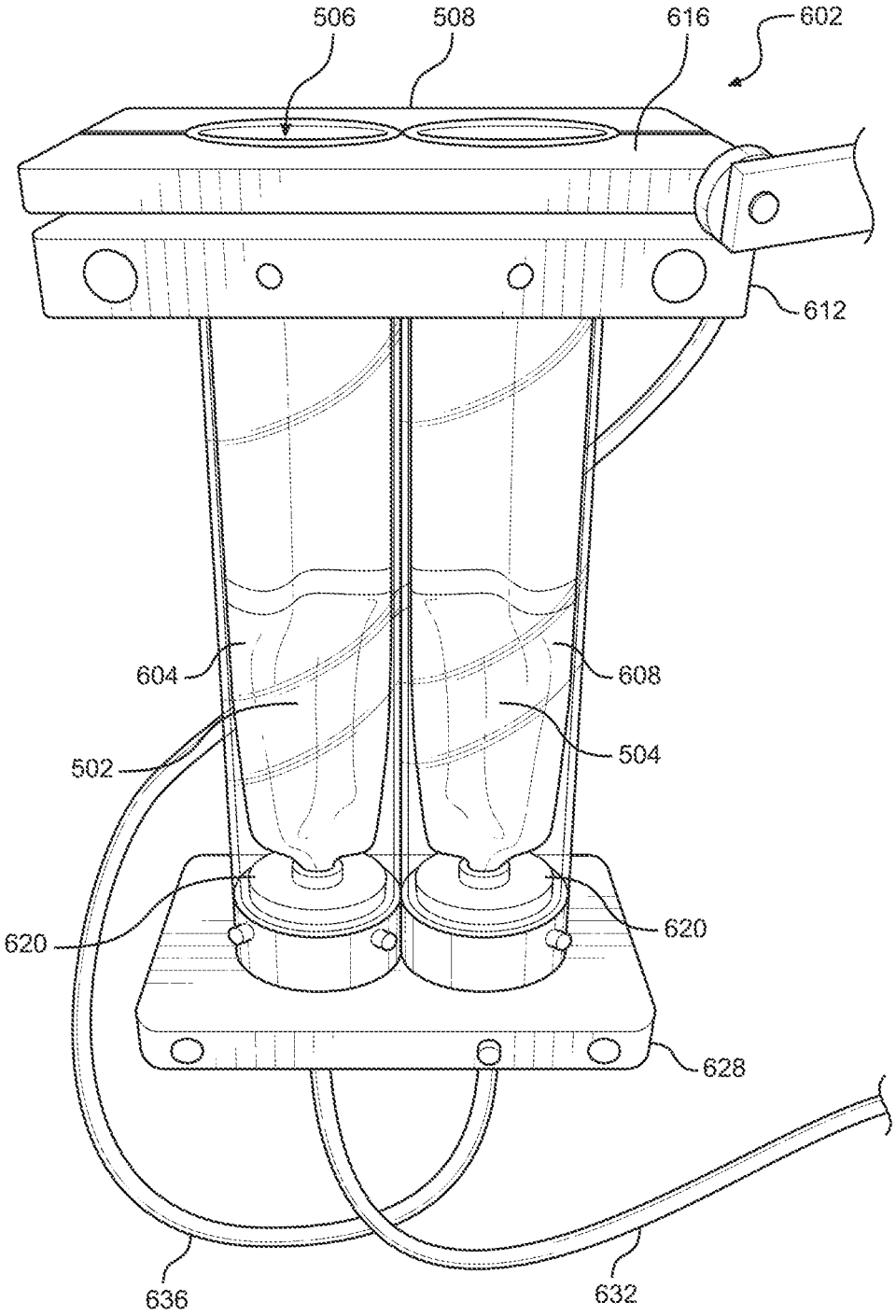
FIG. 29B depicts the fill system of FIG. 29A with a film pack engaged, where the film bags of the film pack are in an unexpanded state.

In order to facilitate easy loading and removal of the film pack 500, when the vacuum device 602 does not contain a film pack 500, one or both of the first and second locking sections 616*a*, 616*b* can be rotated away from each other such that the film bags 502, 504 can be inserted into the respective first and second chambers 604, 608. Upon inserting the film bags 502, 504 into the vacuum device 602, one or both of the first and second locking sections 616*a*, 616*b* can rotate towards each other such that each of the first and second locking sections 616*a*, 616*b* engage the first and second portions 506*a*, 506*b* of the face plate 506 of the film pack 500. Thus, the locking plate 616 secures film bags 502, 504 within the vacuum device 602 through engagement with the face plate 506. FIG. 29A shows the first and second locking sections 616*a*, 616*b* rotated away from each other, such that the vacuum device 602 can receive a film pack 500, while FIG. 29B shows the first and second locking sections 616*a*, 616*b* rotated towards each other and engaged with a face plate 506 of a film pack 500, such that the film bags 502, 504 are secured within the vacuum device 602. Though a hinged locking plate 616 is described, other methods and structures for locking the film pack 500 within the vacuum device 602 are contemplated.

On the opposite side of the first and second chambers 604, 608, the second ends 604*b*, 608*b* of the first and second chambers 604, 608 can be secured to a base 628. Within each of the first and second chambers 604, 608 can be disposed a respective seal 620 that aids in creating an airtight seal within the first and second chambers 604, 608, as will be discussed below. Each of the seals 620 can define a respective bore that extends through an entirety of the seal 620. For example, the seal 620 disposed within the first chamber 604 can define a first bore 624*a*, while the seal 620 disposed within the second chamber 608 can define a second bore 624*b*. The first bore 624*a* can be in communication with a tube 632 that extends through the base 628 of the vacuum device 602, while the second bore 624*b* can be in communication with a tube 636 that extends through the base 628. Each of the tubes 632, 636 can comprise a flexible polymer, and extend from the respective first and second chambers 604, 608 to a pump 640. The pump 640 can be utilized to impart a positive or negative pressure to the interior of the first and second chambers 604, 608 through the tubes 632, 636, as will be discussed further below. The pump 640 may also be referred to as a first pump.

Figure 30:
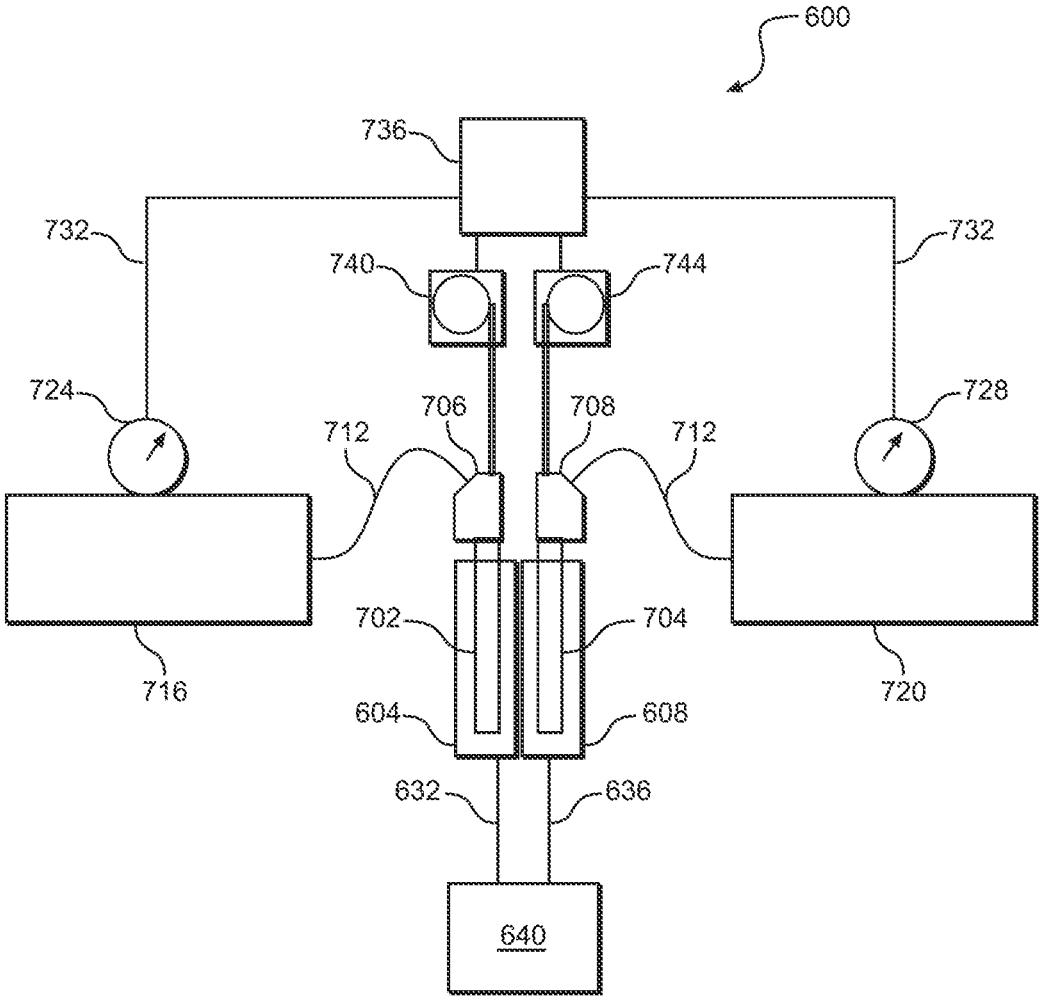
FIG. 30 depicts a schematic diagram of the fill system of FIG. 29A.
Figure 31:
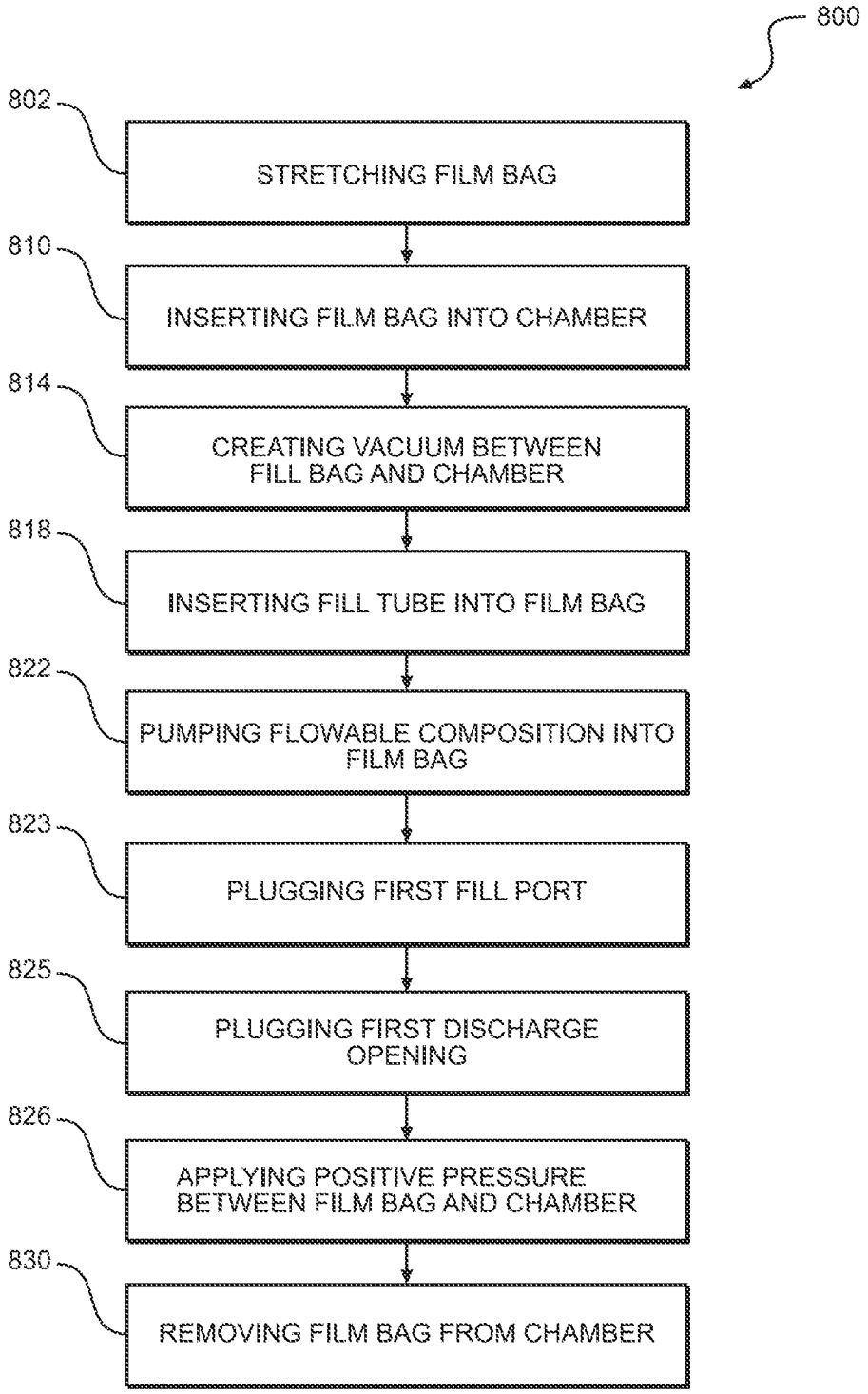
FIG. 31 depicts a process flow diagram of a method for filling a film pack using the fill system shown in FIG. 29A in accordance with an embodiment of the invention.

Now referring to FIG. 30, the fill system 600 can further include components related to filling the film bags 502, 504 when the film bags are disposed within the first and second chambers 604, 608. The fill system 600 can include a first fill tube 702 configured to be inserted into the first chamber 604, particularly the film bag 502 when the film bag 502 is disposed within the first chamber 604, and a second fill tube 704 configured to be inserted into the second chamber 608, particularly the film bag 504 when the film bag 504 is disposed within the second chamber 608. Each of the first and second fill tubes 702, 704 is configured to be inserted through the first and second fill ports 507*a*, 507*b*, respectively of the face plate 506. However, in other embodiments it is contemplated that the fill system 600 will not include the first and second fill tubes 702, 704, as well as the first and second fill ports 507*a*, 507*b*, and the film bags 502, 504 will rather be filled directly through the first and second discharge openings 510*a*, 510*b* of the nosepiece 508.

The top of the first fill tube 702 can include a fill head 706, while the top of the second fill tube 704 can include a fill head 708. Each of the fill heads 706, 708 can be operatively attached to a respective motor. In the depicted embodiment, the first fill tube 702 and fill head 706 can be operatively coupled to a first motor 740, while the second fill tube 704 and the fill head 708 can be operatively coupled to a second motor 744. Though two motors are shown, in another embodiment each of the fill heads 706, 708 can be operatively coupled to a single motor. The first and second motors 740, 744 are configured to insert the first and second fill tubes 702, 704, respectively, into the film bags 502, 504, respectively, and subsequently remove the first and second fill tubes 702, 704 from the film bags 502, 504. The first and second motors 740, 744 can be configured to move the first and second fill tubes 702, 704 together or independently.

Each of the first and second motors 740, 744 is controlled by a controller 736. The controller 736 can be a programmable logic controller (PLC), a microprocessor based controller, a personal computer, or another conventional control device capable of carrying out the functions described herein as understood by a person having ordinary skill in the art. For example, the controller 736 can perform the various methods relating to controlling the fill system 600 based upon user input, as described in detail below. Additionally, the controller 736 can perform the various methods related to controlling the fill system 600 based upon a library of operational cycles or sequences that are stored in a memory unit (not shown) of the controller 736. The memory unit may include one or more memory units, and may also be referred to as a storage device. The operational sequences are recalled and placed in a particular control program, as desired, executing on the controller 736. The operational sequences can be adjusted to accommodate different filling operations, types of film bag or flowable composition, or different dimensions of film pack or chamber, for example through a user interface (not shown).

The fill heads 706, 708 can also be connected to respective first and second pumps 716, 720 through tubes 712. The first and second pumps 716, 720 can be used to pump the flowable compositions from composition sources (not shown), through the tubes 712, and to the respective first and second fill tubes 702, 704. Each of the first and second pumps 716, 720, collectively or individually, can be referred to as a second pump when compared to the pump 640. Like the first and second motors 740, 744, each of the first and second pumps 716, 720 can be controlled by the controller 736 through a wired connection 732 with the controller 736. The controller 736 can monitor the progress of a filling operation performed by the first and second pumps 716, 720 through a variety of means. In the depicted embodiment, the fill system 600 includes a flow monitor 724 in communication with the first pump 716, where the flow monitor 724 is configured to monitor the flow rate of flowable composition from the first pump 716 to the first fill tube 702 and communicate aspects of the flow to the controller 736. The fill system 600 also can include a flow monitor 728 in communication with the second pump 720, where the flow monitor 728 is configured to monitor the flow rate of flowable composition from the second pump 720 to the second fill tube 704 and communicate aspects of the flow to the controller 736.

Continuing with FIGS. 26A-27B and 31, a method 800 for filling the flexible film bags 502, 504 with a flowable composition will be described. Though the method 800 is equally applicable to both of the film bags 502, 504, the method 800 will only be described in relation to film bag 502 for simplicity. First, step 802 can be performed, in which the film bag 502 can be stretched to provide an easy lead-in for flowable composition that will enter the film bag 502 during the filling operation. Specifically, the film bag 502 can be stretched in the longitudinal direction L by applying a force $F_1$ to the proximal end 502*a* of the film bag 502, and a force $F_2$ to the distal end 502*b* of the film bag 502. Though two forces are depicted, one of the ends of the film bag 502 can be secured without applying a force while a force is applied to the opposite end. Further, the forces $F_1$ and $F_2$ can be different or the same as desired. Though the term "stretching" is used, step 802 does not necessarily involve a physical elongation of the film bag 502—rather, the film bag 502 can simply be pulled taut to achieve a maximum length.

Once the film pack 500 is in a taut state after step 802, the film pack 500 can be arranged as shown in FIG. 27B for transportation. As shown, a first film pack 500 can have a first face plate (e.g., 506 labeled in FIG. 27A), and the proximal end of the first film pack 500 can be attached to the first face plate. The first film pack 500 can be arranged in contact with a second film pack 500 such that the distal end of the first film pack 500 is disposed between the first face plate and a second face plate 506 (e.g., 506 labeled in FIG. 27A) attached to the second film pack 500.

This configuration, which can include any amount of film bags 502, 504, allows the film bags 502, 504 to remain in the taut state achieved in step 802 throughout the supply chain until finally reaching the intended destination for final use.

Figure 29C:
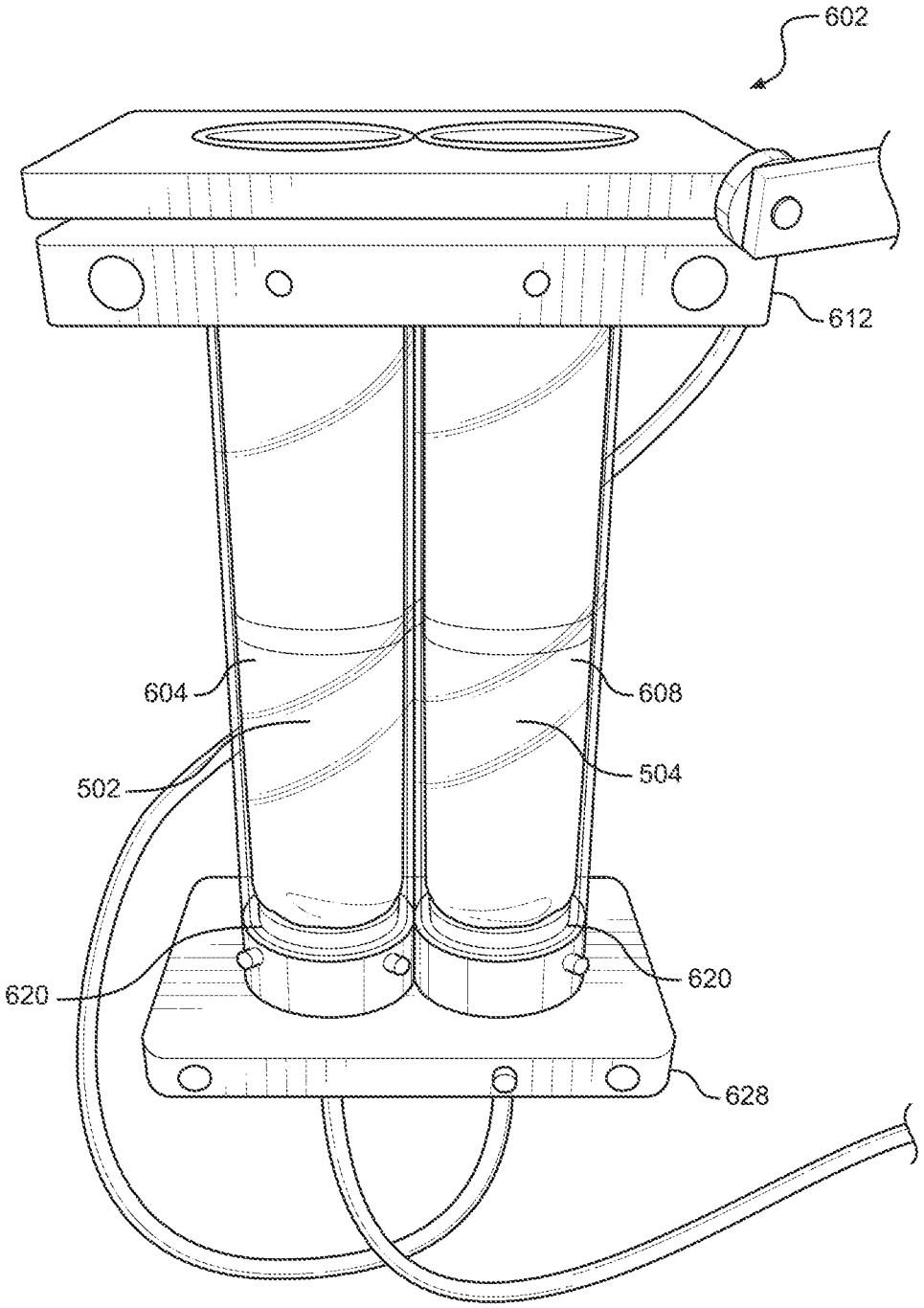
FIG. 29C depicts the fill system of FIG. 29A with a film pack engaged, where the film bags of the film pack are in an expanded state.

Upon reaching the intended destination, an operator of the filling system 600 can perform step 810 by inserting a particular film bag 502 into a chamber, such as the first chamber 604 of the vacuum device 602. Though inserting a single film bag 502 into the first chamber 604 is described below, step 810 and the following processes can be performed in relation to both the film bag 502 and film bag 504 simultaneously. However, only film bag 502 will be described in relation to the following steps for simplicity and brevity. As described above, when a particular film pack 500 is inserted into a vacuum device 602, the first and second sections 616*a*, 616*b* of the locking plate 616 can be rotated away from each other. As such, inserting the film bag 502 into the first chamber 604 can involve rotating the first and second sections 616*a*, 616*b* of the locking plate 616 such that the locking plate 616 engages the face plate 506 of the film pack 500 to secure the film bag 502 within the first chamber 604. Upon inserting the film bag 502 into the first chamber 604, step 814 can be performed, in which a vacuum is created in the space between the exterior surface of the film bag 502 and the interior surface of the first chamber 604. This can be performed by the pump 640, which imparts a negative pressure on the aforementioned space through tube 632. As a result of this vacuum, the film bag 502 can transition from an unexpanded state, as shown in FIG. 29B, to an expanded state, as shown in FIG. 29C. This provides the fill tube 702, which will be described below, access to the entire expanded interior volume of the film bag 502, which ensures that the film bag 502 is optimally and completely filled with a flowable composition. Optimally, the vacuum can be created at between 29-30 inches of Mercury, though less of a vacuum is also contemplated.

After the vacuum is created in step 814, step 818 is performed, in which the fill tube 702 is inserted into the film bag 502 through the face plate 506, particularly the first fill port 507*a* of the face plate 506. Once the fill tube 702 is fully inserted into the film bag 502, the flowable composition can be pumped into the film bag 502 in step 822. This is driven by the piston of the first pump 716, which drives the flowable composition from a composition source (not shown), through the tube 712, through the fill head 706 and fill tube 702, and into the film bag 502.

Figure 26A:
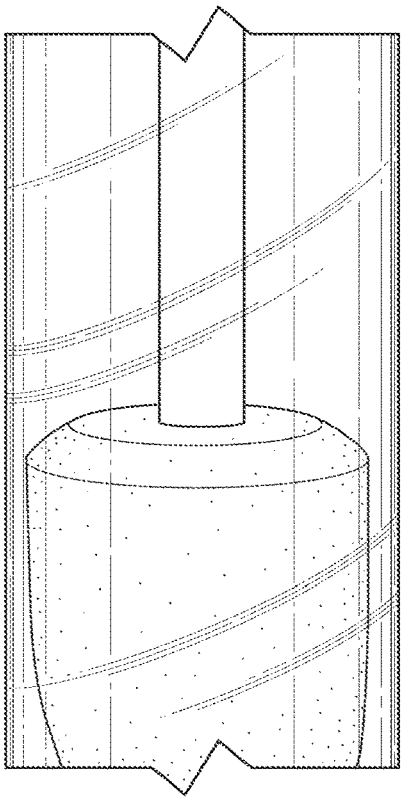
FIG. 26A depicts a first filling operation.
Figure 26B:
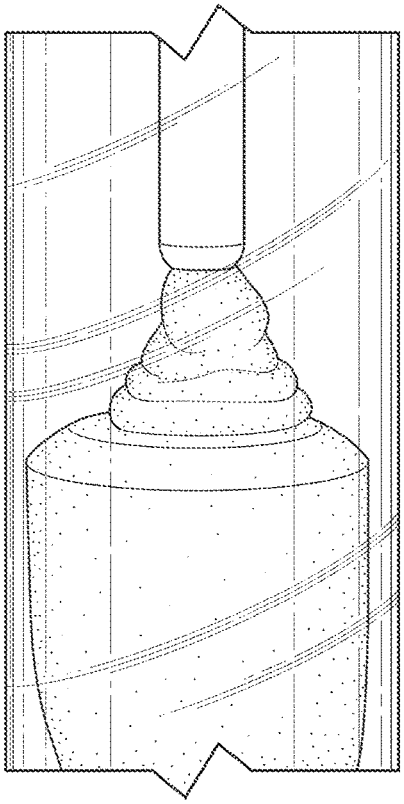
FIG. 26B depicts a second filling operation.

While the fill tube 702 is filling the film bag 502, it will become necessary to gradually remove the fill tube 702 from the film bag 502. There can be several detrimental results if the rate of retraction of the fill tube 702 from the film bag 502 is not correct. For example, as shown in FIG. 26A, a fill tube is not being retracted fast enough while filling a chamber. This can result in contamination of the fill tube, and can lead to air entrapment in the flowable composition. Likewise, in FIG. 26B a fill tube is being retracted too fast while filling a chamber. This can also result in air entrapment in the flowable composition. All of these side effects of incorrect fill tube removal speed lead to incomplete and inconsistent filling of film packs, particularly with flowable compositions having higher viscosities that are not self-leveling.

To ensure that these negative consequences do not occur, the fill tube 702 is gradually removed from the film bag 502 during the filling operation according to step 822. In step 822, at the direction of the controller 736, the motor 740 performs the function of gradually removing the fill tube 702 from the film bag 502 at a deliberate speed. This speed can be determined by the controller 736. The piston position of the pump 716 can be monitored by a linear variable differential transformer (LVDT) and communicated to the controller 736 to determine piston speed as a function of position and time. The controller 736 can use these inputs, as well as inputs provided by other sensors not described herein, and direct the motor 740 to remove the fill tube 702 from the film bag 502 at a speed calculated according to the following equation:

$$\text{Fill Tube Removal Speed}=(P_s*P_a)/C \qquad \text{Equation 1}$$

where:

$P_s$=Pump Piston Speed $P_a$=Pump Cross Sectional Area

C=Cross Sectional Area of Flexible Fill Bag in Expanded State.

The controller 736 can continuously calculate the desired retraction speed of the fill tube 702 using Equation 1 such that the controller 736 defines a feedback loop. Should a subsequently calculated value according to Equation 1 differ from the current retraction speed of the fill tube 702, the controller 736 can direct the motor 740 to alter the retraction speed accordingly. Optimally, retracting the fill tube 702 at a speed according to Equation 1 will allow the distal head of the fill tube 702 to be spaced slight ahead of the level of the flowable composition within the film bag 502.

After the completion of step 822, in step 823 the first fill port 507*a* can be plugged such that none of the flowable composition escapes the film pack 500. Also, after the completion of step 822, in step 825 the first discharge opening 510*a* can be plugged so as to further prevent any of the flowable composition from escaping the film pack 500. After the completion of step 822, the film pack 500 must be removed from the fill system 600. However, the vacuum applied to the film bag 502 and first chamber 604 created by the pump 640 in step 814 can still exist to some degree, rendering removal of the film bag 502 from the first chamber 604 somewhat difficult. As a result, in step 826 the operator can transition the pump 640 from a first state, where the pump 640 creates the vacuum within the first chamber 604, to a second state, where the pump applies a positive pressure through the tube 632 to the space between the exterior surface of the film bag 502 and the interior surface of the chamber 604. This positive pressure can relieve the vacuum and allow the film pack 500 to be easily removed from the vacuum device 602 in step 830. In one embodiment, this positive pressure can be about 10 psi, though positive pressures at different levels are also contemplated.

While the invention is described herein using a limited number of embodiments, these specific embodiments are not intended to limit the scope of the invention as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in a particular order as desired.

What is claimed is:

1. A method for filling a flexible film bag attached to a face plate, the method comprising:

inserting the flexible film bag into a chamber;

creating a vacuum between an exterior surface of the flexible film bag and an interior surface of the chamber, such that the flexible film bag expands from an unexpanded state to an expanded state;

inserting a fill tube into the flexible film bag through an opening in the face plate, the faceplate defining a nosepiece that extends proximally from the face plate opposite the flexible film bag; and dispensing a flowable composition through the fill tube and into the flexible film bag while the fill tube extends through the opening into the flexible film bag.

2. The method of claim 1, wherein dispensing the flowable composition includes gradually removing the fill tube from the flexible film bag.

3. The method of claim 2, wherein gradually removing the fill tube from the flexible film bag is performed by a motor operatively connected to the fill tube.

4. The method of claim 3, wherein gradually removing the fill tube is controlled by a controller in electrical communication with the motor.

5. The method of claim 4, wherein dispensing the flowable composition is performed by a pump that includes a piston, wherein the pump is in fluid communication with the fill tube.

6. The method of claim 5, wherein the controller directs the motor to remove the fill tube from the flexible film bag according to the equation:

$$\text{Fill Tube Removal Speed}=(P_s*P_a)/C$$

where:

$P_s$=Pump Piston Speed $P_a$=Pump Cross Sectional Area

C=Cross Sectional Area of Flexible Fill Bag in Expanded State.

7. The method of claim 1, wherein the chamber defines a first end and a second end opposite the first end, such that the face plate is adjacent to the first end of the chamber.

8. The method of claim 7, wherein creating the vacuum is performed by a pump in fluid communication with the second end of the chamber.

9. The method of claim 1, further comprising:

applying a first force to a proximal end of the flexible film bag and a second force to a distal end of the flexible film bag opposite the proximal end to expand the flexible film bag in a longitudinal direction.

10. The method of claim 9, wherein the flexible film bag is a first flexible film bag and the face plate is a first face plate, and the proximal end of the first flexible film bag is attached to the first face plate, the method further comprising:

arranging the first flexible film bag in contact with a second flexible film bag such that the distal end of the first flexible film bag is disposed between the first face plate and a second face plate attached to the second flexible film bag.

11. The method of claim 1, further comprising:

applying a positive pressure between the exterior surface of the flexible film bag and the interior surface of the chamber; and removing the flexible film bag from the chamber.

12. The method of claim 1, further comprising:

plugging a fill port of the face plate after dispensing the flowable composition, wherein the fill port is configured to receive the fill tube.

13. The method of claim 12, further comprising:

plugging a discharge opening defined by the nosepiece extending from the face plate, wherein the discharge opening is in fluid communication with the flowable composition within the flexible film bag.

14. The method of claim 1, wherein creating the vacuum includes securing the flexible film bag within the chamber via the vacuum.

15. A system for filling a flexible film bag, the system comprising:

a chamber for receiving the flexible film bag, the flexible bag being attached to a faceplate that defines a nosepiece that extends proximally from the face plate opposite the flexible film bag;

a locking plate attached to the chamber and having first and second locking sections that can rotate towards each other to releasably engage the face plate, such that the flexible film bag is secured within the chamber;

a fill tube for dispensing a flowable composition through an opening of the faceplate into the flexible film bag, wherein the fill tube is configured to be at least partially inserted through the opening into the flexible film bag; and a first pump in fluid communication with the chamber, wherein the first pump is configured to create a vacuum between an exterior surface of the flexible film bag and an interior surface of the chamber, such that the flexible film bag expands from an unexpanded state to an expanded state.

16. The system of claim 15, further comprising a motor operatively connected to the fill tube, wherein the motor is configured to insert the fill tube into the flexible film bag and remove the fill tube from the flexible film bag.

17. The system of claim 16, further comprising a controller configured to control operation of the motor.

18. The system of claim 17, further comprising a second pump that includes a piston for pumping the flowable composition from a source to the fill tube.

19. The system of claim 18, further comprising a flow meter in fluid communication with the second pump, wherein the flow meter is configured to communicate a flow rate of the flowable composition to the controller.

20. The system of claim 18, further comprising a linear variable differential transformer (LVDT) for detecting a position of the piston, wherein the LVDT is configured to communicate the position of the piston to the controller.

21. The system of claim 18, wherein the controller is configured to direct the motor to remove the fill tube from the bag film bag according to the equation:

$$\text{Fill Tube Removal Speed}=(P_s*P_a)/C$$

where:

$P_s$=Pump Piston Speed $P_a$=Pump Cross Sectional Area

C=Cross Sectional Area of Flexible Fill Bag in Expanded State.

22. The system of claim 15, further comprising:

a tube that extends from the chamber to the first pump; and a seal disposed within the chamber for creating an airtight seal between the tube and the chamber.

23. The system of claim 15, wherein the first pump is configured to transition from a first state, where the first pump creates the vacuum between the exterior surface of the flexible film bag and the interior surface of the chamber, and a second state, where the first pump applies a positive pressure between the exterior surface of the flexible film bag and the interior surface of the chamber.

24. The system of claim 15, wherein the vacuum created between the exterior surface of the flexible film bag and the interior surface of the chamber is configured to secure the flexible film bag within the chamber.

* * * * *